US006634953B1

(12) United States Patent
Czintos

(10) Patent No.: US 6,634,953 B1
(45) Date of Patent: Oct. 21, 2003

(54) SLIDING SLOPE AND MEANS FOR SLIDING DOWN OBJECTS OR PERSONS

(76) Inventor: Csongor Czintos, 3, Csáky Utca, Kecskemét (HU)

( * ) Notice: Subject to any disclaimer, the term of this patent is extended or adjusted under 35 U.S.C. 154(b) by 0 days.

(21) Appl. No.: 10/018,799

(22) PCT Filed: Jun. 21, 2000

(86) PCT No.: PCT/HU00/00058

§ 371 (c)(1),
(2), (4) Date: Mar. 21, 2002

(87) PCT Pub. No.: WO00/78417

PCT Pub. Date: Dec. 28, 2000

(30) Foreign Application Priority Data

Jun. 21, 1999 (HU) ..... 9902073

(51) Int. Cl.[7] ..... A63C 19/10

(52) U.S. Cl. ..... 472/90; 472/91; 472/117; 104/69

(58) Field of Search ..... 472/88, 89, 90, 472/136, 137, 116, 117, 128; 104/53, 69, 70

(56) References Cited

U.S. PATENT DOCUMENTS

| | | | | | |
|---|---|---|---|---|---|
| 1,274,824 A | * | 8/1918 | Wallace | 472/116 |
| 2,174,716 A | | 10/1939 | Bethell | |
| 3,429,067 A | * | 2/1969 | Yancey | 472/89 |
| 4,087,088 A | * | 5/1978 | Kelso | 472/91 |
| 4,148,477 A | * | 4/1979 | Larson | 472/91 |
| 4,339,122 A | * | 7/1982 | Croul | 104/70 |
| 4,423,864 A | * | 1/1984 | Wiik | 472/91 |
| 4,836,521 A | * | 6/1989 | Barber | 104/86 |
| 5,507,695 A | * | 4/1996 | Sajakorpi | 472/88 |
| 5,738,590 A | * | 4/1998 | Lochtefeld | 472/117 |
| 5,951,357 A | * | 9/1999 | Mandle et al. | 446/138 |

FOREIGN PATENT DOCUMENTS

| | | |
|---|---|---|
| EP | 0 303 958 | 2/1989 |
| FR | 2 254 354 | 7/1975 |
| GB | 1 429 900 | 3/1976 |

* cited by examiner

*Primary Examiner*—Kien T. Nguyen
(74) *Attorney, Agent, or Firm*—Young & Thompson

(57) ABSTRACT

A downhill sliding course of sliding track for sliding objects and persons down a slope or a hill includes covering or cladding elements for covering the surface of the slope and a water source to moisten the elements with water. The sliding elements include pools located one below the other, wherein the pools are forming water filled micro-terraces (10). The micro-terraces (10) are formed by a sheet covering the slope in a water-tight manner and flexible ribs (2) are emerging from the sheet, furthermore each pool is bordered by the covering sheet (5) and the rib (2) and is closed by a flexible transverse sectioning rib joined to the covering sheet (5) and the flexible rib (2). With suitable accessories activities similar to skiing, sleighing and surfing can be performed on the sliding course. Accordingly, the invention includes also accessories that can be used to perform these activities. The invention provides individual appliances to implement the sliding course.

19 Claims, 20 Drawing Sheets

Fig. 15a
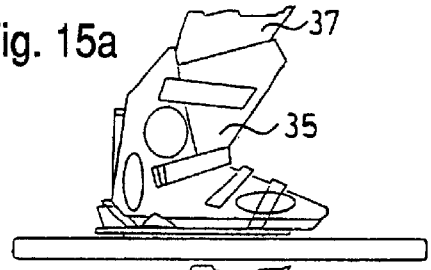
Fig. 15b
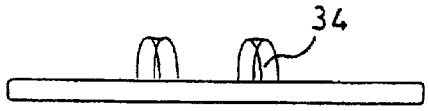
Fig. 15c
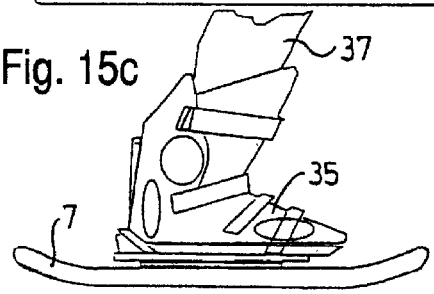
Fig. 15d
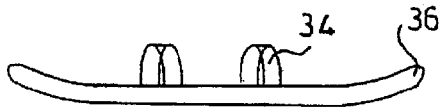
Fig. 15e
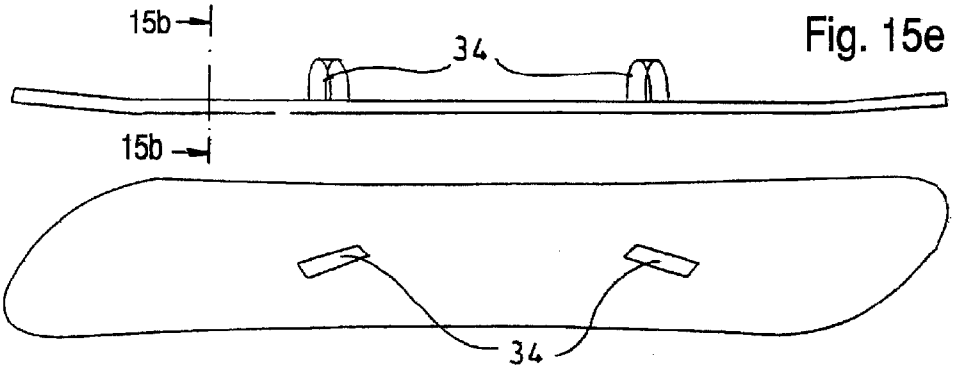
Fig. 15f
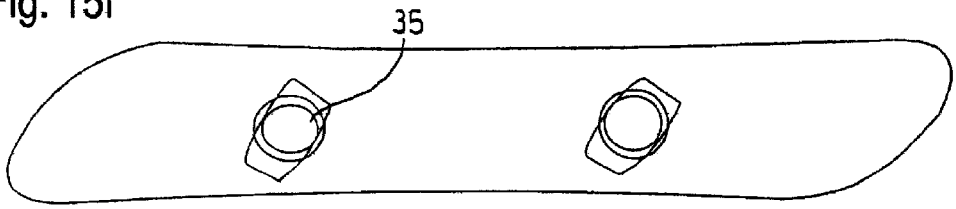
Fig. 15g

SLIDING SLOPE AND MEANS FOR SLIDING DOWN OBJECTS OR PERSONS

TECHNICAL FIELD

The invention relates to a downhill sliding course or sliding track for sliding objects and persons down a slope or a hill comprising of covering or cladding elements for covering the surface of the slope and a water source to moisten the elements with water. With suitable accessories activities similar to skiing, sleighing and surfing can be performed on the sliding course. Accordingly, the object of the invention includes also accessories that can be used to perform these activities. The invention provides individual appliances to implement the sliding course.

BACKGROUND ART

All summer and winter sports are based on conditions created by nature, making use to smaller or grater extent of all possibilities available at the site and the possibilities provided by the climatic conditions.

The biggest obstacle to summer skiing is that water runs-off very fast form the slopes and artificial ski trails. The continuous replacement of the run-off water has been solved earlier too, replacing it by way of a simple pump making the surface of the slope slippery and cooling it at the same time.

But this water is very different from the snow suitable for skiing or from the waves of the ocean. It is not only warmer, melted, but it also moves along (or faster) with the user of the slope, and therefore there is no difference of impulse between them which could be used for control (it is a good visual illustration that an excellent snow covered slope is only suitable for skiing as long as the snow is stagnant, and at the moment the snow starts to slide—when avalanche develops—the skier is no longer able to direct the ski with the help of the snow moving together with him, and is carried away together with any obstacles on its path.

For all sports mentioned above the basic paradigm of physics is valid: namely the phenomenon and law of conservation of momentum. It states that all bodies conserve their original state of movement as long as external forces do not force them to change it. In an closed system comprising two bodies of any type the change in the state of motion of one of the bodies is equal to the change in the state of motion of the other. In the instant case the two bodies are the user and the sliding course (slope) or the user and the water. Thus, changing the state of motion is only possible, if there is an other body, which can be forced to change its state of motion. This other body can be the Earth, sufficient quantity of water, air, etc. The change in the state of motion is determined by the vector sum of the effect of one or more forces. In the case of skiing, the change in the state of motion for hard slope is the result of the friction force and the force of inertia of the dislodged snow, while for powder snow the force of inertia of the dislodged snow alone. In the case of surfing the reaction force of the dislodged water enables the sports person to control the movement. In the case of slides directing is impossible as the water moves together with the user, sometimes even faster than the user, and instead of giving a support for controlling direction the water sweeps away the user using a different sign forcing.

One of the most enjoyable types of sliding is ski, particularly Alpine skiing. The sliding modes described in the technical state of the art try to create all these enjoyment in the climatic conditions of summer. All modes, which have become independent sport can reproduce however only in a limited way the feeling of sliding down a high forest slope on a stable snow. Besides their special advantages and extraordinary richness in experience all have some disadvantages, which should be eliminated.

We have observed that sea wave surfing is the sport that provides the movement experiences closest to skiing (and within that the sport that co-ordinates movement in a slope at a higher level, snowboarding, which is expanding rapidly). Nevertheless, there are a number of circumstances that hinder it becoming a real mass sport.

- It can only be pursued at sections of the beach where the wind and soil surface support the evolution of exceptionally high, braking waves. (Skiing too, can only be pursued in winter, and only on the mountains, and thus, for instance, the several billion people living in poorer and warmer countries are excluded form it.)
- It is only possible to surf when wind conditions are ideal (it is only possible to ski when snow conditions are good, although snow cannons are already available).
- In order to have time to enjoy travelling upon the waves it is necessary to get into the see far away from the shore swimming hard. (this corresponds to the necessity of climbing up to the top of a hill in order to slide down).

U.S. Pat. No. 4,339,122 describes a slide of inhomogeneous inclination built on sloped terrain, imitating the experience of wave surfing, where the slippery surface is provided by a constant flow of water onto a plastic surface coming from pipes located at not too big distances from each other on the underside, while the surfer slides down the slide on a footboard similar to the surfing board or a snowboard.

The deficiencies of this known solution are the following:

- The water supply of the sloped surface is not solved. The planned water supply system is not able to provide an even water layer with even water thickness.
- The thickness of the water is unregulated to such an extent, that is not possible to exclude fully the formation of deep rivulets, streams hindering the sliding down, while at other places the covering surface might remain completely dry. For this reason, the friction and resistance will change from centimeter to centimeter making the control of direction more difficult.

Nothing in the irregular covering surface with a curvature that is not pre-calculable, ensures the even spreading of the water. The introduction of the water at numerous discrete points provides only an imaginary solution and only at the start of the operation, since at the points of outflow as a result of the special outlet the water spreads, but due to the unevenness and curvature of the surface on the one hand, and to the springing effect of surface tension, after a distance of just but a fraction of a meter the water forms a stream.

It is a significant disadvantage that the water needs to be supplied almost evenly on the whole height of the route for even the hope of having the water spread evenly, but in this way at the bottom of the slope the full volume of water is collected and the water layer will probably be thick, making impossible to control the direction of sliding and taking away the enjoyment.

The depicted water supply system requires large volumes of water as the water poured onto the surface flows away immediately and so the water must be replaced continuously, otherwise the surface will not be evenly moist. To minimize water demand the inclination of the slope must be maximized at 7–20 deg.

The yield of the water outlet points must be carefully regulated, but at least carefully adjusted, and this is a meter the patent does not discuss at all. Lacking this, the inequality of the water flow is even greater.

The water outlet points and the piping conducting to them must be positioned before the construction of the track covering, and therefore the effect of the water-film and how much additional water is still required can only be observed later, but modifications, if necessary, can only be carried out by breaking-up the covering.

Should the water run on the track be spread evenly in spite of the above, even then a favorable direction control could not be achieved as the principle of physics to be described later suffers, as the momentum conservation phenomena used for controlling direction does not make the change in the state of motion possible for bodies moving together.

In practice, the shaping of the sliding device "board" makes difficult and cumbersome the required steering. The exertion of the bottom steering element arrests the slide at times even when this is not desirable, and when turning (banking) the user must tilt over the plane defined by the steering element and the board, which causes instability.

At higher speeds the protuberant bottom steering element will only sink into the material of the covering panel and produced the required effect if the user is rather experienced Oust think about unwilling acceleration).

EP 0 873 770 A1 "SURFSLIDING METHOD AND APPARATUS FOR SLIDING ON ARTIFICAL SURFACES" provides method and apparatus for surfing on artificial surface.

The shortages of this known method are the following:

does not provide even miniaturization, because although the excess drip water is partially drained, it is not able to spread evenly the water from the supply pipes.

Huge amounts of water are required for continuous operation, even when the water in the different sections is individually recalculated.

Huge dimensions also are required for the desired operation, as the size of the canal visibly exceeds that of a house.

Large amounts of capital are needed for constructing an architecturally correct facility.

It is questionable whether is it possible for more than one sports person to be close by.

It demands extensive surfing experiences.

The principle of operation resembles more that of the roller boarding than surfing, i.e. at high speeds it is difficult to stop based on braking on artificial grass, and thus the tracks planned for high speed can be life threatening.

The length of the characteristically enclosed track must be limited for clear end-to-end visibility; otherwise it is not possible to provide fast help in case of possible accidents.

DISCLOSURE OF THE INVENTION

The aim to be achieved by the invention is the production of a sliding course enabling direction controlled sliding executed on it on a suitable sloping terrain along with an additional auxiliary aim to provide an enjoyment or experience similar to winter skiing in summer, optionally to make it suitable for use in recreation parks, ski trail tracks or in enclosed or indoor areas. A further objective is that the sliding course be safe, environment friendly, energy and water saving, that its construction, maintenance and repair be as simple and cost saving as possible and that its use be easy to learn.

There are no sports opportunities in the summer recreation parks, bathing establishments that serve this purpose, require activity, and action, provide individual and collective enjoyment without requiring skill and knowledge, but demand toil and offer challenge. People looking for diversion can only chose dry-land team sports, i.e. ball games or at the most, can enjoy the passive delights of a slide, or can chose as recreation the passive joys of doing nothing.

It is true in general; the real enjoyment for people is action, movement that he is able to control at (direct) all times. There are actions that offer momentary pleasure e.g. slides, when for a short period the person looses control over their state of motion, but only because it is evident right form the beginning, that at the end they will arrive at a safe, controlled state.

The realization of an apparatus suitable to turn the world-wide practiced winter skiing, that had become a mass sport available to all into a sports activity that can be pursued In summer as an aquatic sport, by having the micro-terraces made along the surface of the slides made of more slippery material than ever, and made even more slippery with water poured on it stop the downpour of water, and thus rendering the sliding surface suitable for having direction controlled movement made on it.

If the upper surface layer of the water mass is separated by a suitable, watertight plastic sheet with a smooth surface, suitably soft and flexible, and dividing the water layer thus produced into small pools located in compartments, micro-terraces, than these micro-terraces will not allow the water to pour down. The losses caused by small seeping and the water dislodged during the use by objects, sports people, surfers sliding down can be simply replaced with the water pumped into the basin located at the top of the slide so that the water runs through a slipover and flows smoothly to the uppermost micro-terrace and down the others one after the next to the lowest micro-terrace replacing the water shortage in each of them.

The sliding course, which represents the most general solution of the task set, is given in claim No. 1. Its advantageous implementations are defined in pending claims 2–13.

The invention provides solution for the task from yet an other aspect, which is the covering element that serves to make the sliding course. The structure of this covering element is described in claim 18.

BRIEF DESCRIPTION OF THE DRAWINGS

The invention is described in more detail with reference to the exemplary embodiments shown in the drawings.

FIGS. 15*a–g* shows different pictures of a version of sliding device similar to the snow board which can be used on the sliding course according to the invention.

DESCRIPTION OF PREFERRED EMBODIMENTS OF THE INVENTION

Figure 1:
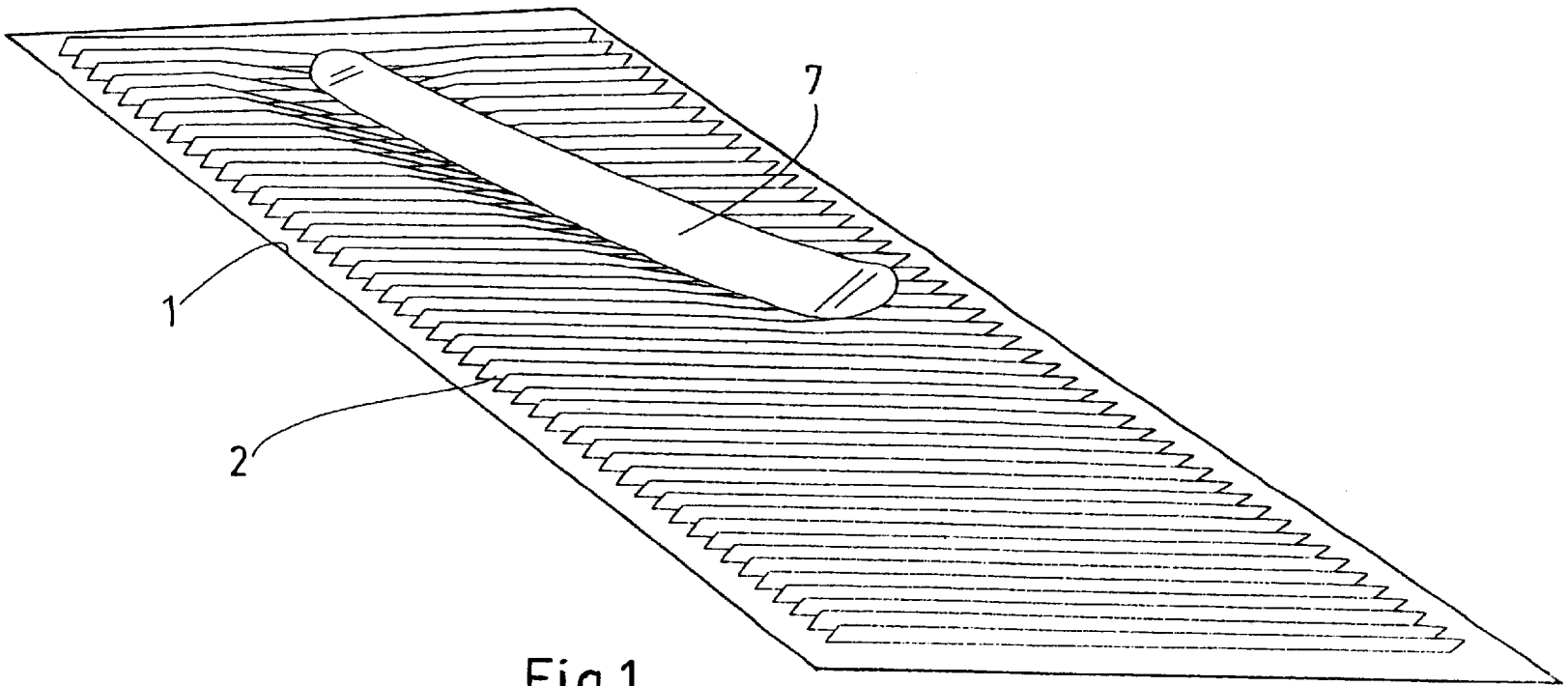
FIG. 1 is a detail of a sliding course according to the invention with a sliding appliance on it.

FIG. 1 shows the operation of the sliding course 1 according to the invention. The sliding course has a sliding surface from which ribs 2 protrude. Between the ribs 2 there are gaps, slots, cavities, depressions or pools, respectively, containing water and so a sliding device 7 placed on top of the ribs 2 presses the ribs made of flexible material from the inside, which bend down. When the ribs bend down the sliding device 7 dislodges the water filling the pools between the ribs 2, consequently, changes the state of motion. The force required for it acts on the sliding device 7 and thereby steering motions can be achieved similar to skiing if suitably controlled.

Figure 2:
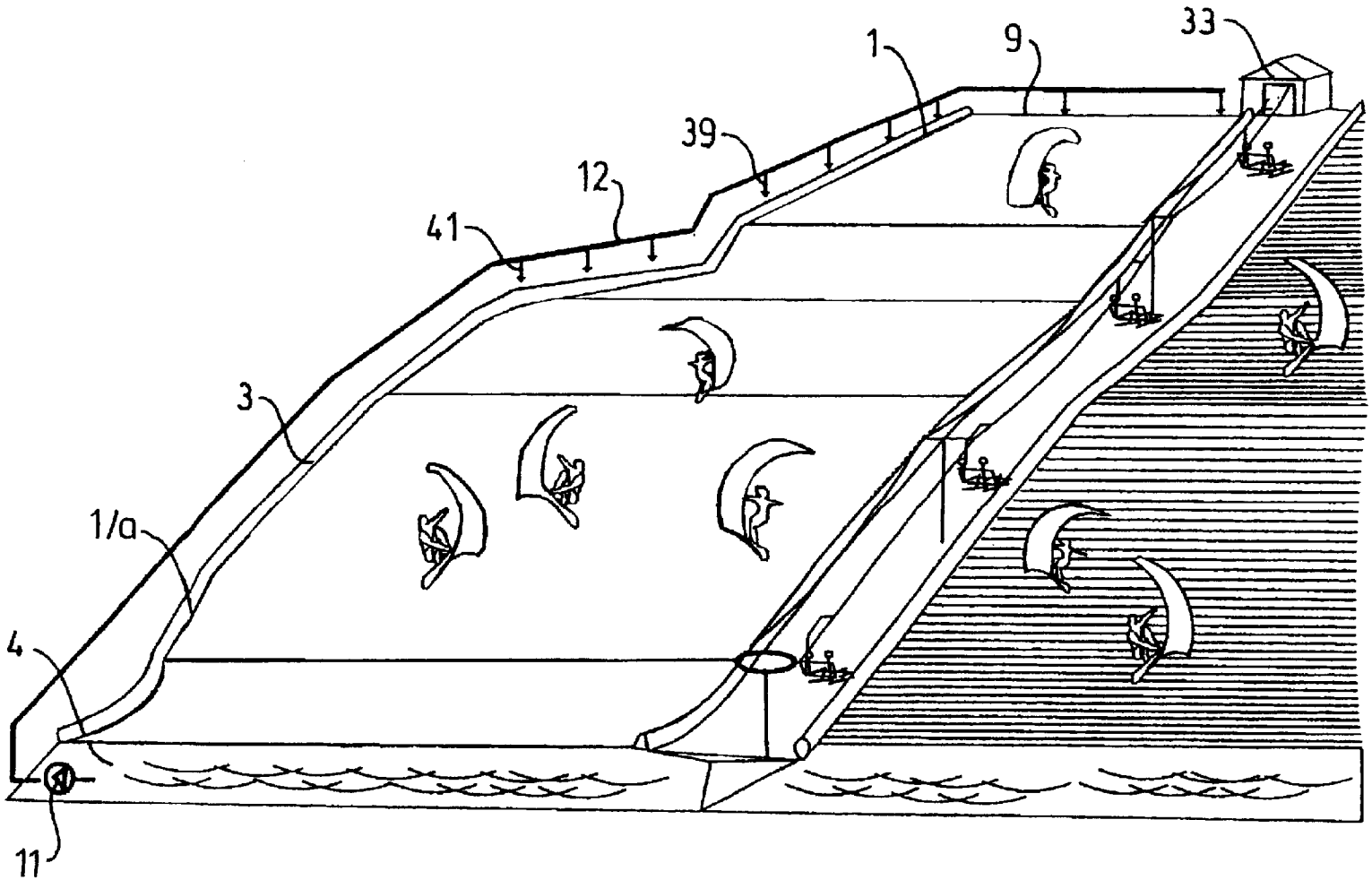
FIG. 2 is an overall picture of a sliding course according to the invention and a lift installed along it.

One of the advantageous solutions of the invention is the sliding surface 1 mounted for support on a slope 20 e.g. as found in nature or constructed, installed in recreation parks or bathing establishments. The sliding surface 1 due to its width, provides sufficient place for the maneuvering required during surfing. FIG. 2 shows a sliding course installed in such a larger area, where for instance the sliding surface 1 is placed on a hillside. The hillside is not necessarily straight and therefore the sliding surface 1 can include jumps 1*a* on the proficient part of the slope. At the top of the hill there is a more or less horizontal launching pad 9 and the sliding surface 1 begins there. The sliding surface 1 widens along the slope, and both above it and along its sides there are water feeders 39 water feeders 39 must be arranged especially at the top of the sliding surface 1 and at widening sections of it. Each water feeder 39 is equipped with an adjusting element or control valve 41. There are protective guard-rails 3 at the side of the sliding surface 1 which prevents the water from running off, and if made with a suitable, flexible and soft material serves as protection device, preventing the persons sliding down the slope from sliding beyond the sliding surface 1. There is a collecting basin 4 at the bottom of the sliding surface 1. There is a lift 33 by the sliding surface 1 which if necessary can divide the sliding surface into two parts. Both the part below the lift and the sliding surface 1 can be supplied with water continuously, which means that almost identical quantities of water flow down on each partition on the full width of the sliding surface 1. The water is supplied to the water feeder 39 from the collecting basin 4 by a pump 11.

Persons wishing to slide down the sliding surface 1 get to the launching pad 9 located at the top of the hill with the lift 33, from where they can slide down the sliding surface, which is continuously flushed by water slowly streaming to the collecting basin 4 and can execute maneuvers if they wish. During their slide a sliding device 7 can be affixed to their feet pushes down the ribs 2 located on the sliding surface in the manner shown in FIG. 1, and the sliding device 7 transfers a part of the persons and of its own impulse to the water located in the space between the ribs 2. It is mainly due to this transfer of impulse that it is possible to carry out maneuvers during sliding down the sliding surface 1, that is, it is possible to come down in a meandering fashion and not only along a straight line.

The character of the sliding surface 1 is fully identical with all features of the skiing track (FIG. 2). The users sliding down the sliding surface 1 can be seen well. The users starting from the launching pad 9 fasten the sliding device 7 to their feet and doing the maneuvers they wish or now proceed towards the end of the slope.

The outrun surface area 1*b* located at the bottom of the sliding surface 1 has a very slight inclination or can even be a horizontal sliding surface. The importance of the overrun surface 1*b* is to allow the users stop there and break in a more pleasant way.

FIG. 2 shows a lift 33 deployed to make scaling more pleasant, together with its engineering structure. The sliding surface 1 is visibly not horizontal and it does not have an even width. The track sections having different inclination make sliding down more enjoyable. The difference in the width of the course in case of a slight downward widening does not cause problems due to the water spreading effect of the micro-terraces. In case of more significant widening or of using assembly methods other than the horizontal (e.g. slated, distinct micro-terraced, micro-cellular construction mode) it is necessary to provide for additional water feeding. The water is supplied directly to the sliding surface 1 by bleeding the pipe 12 conducted along the track or with separate water supply through control valves 41 or other fixtures, but also spraying can be used, increasing thereby the entertainment feature of the course. Safety rail-rail 3 must be installed at the side of the sliding surface 1. A supplementary water supply could play a role in the faster fill-up of the course as water filling could start simultaneously at different levels of the course. In this case water control must be provided for after the filling, as during use less water is required than during filling.

When narrowing the width of the course, a minor reduction of width will result in an insignificant water surplus, but the water surplus will become significant if the narrowing is more pronounced, creating pleasant and exciting rapid areas, where stopping or passing with ski represents a serious challenge.

The collecting basin 4 located at the bottom of the course should not necessarily be an inherent part of the course. The basin can be hidden, in this case the users will stop on the overrun 1*b*. The basin, however, is indispensable for replacing the run-off water. The pump supplies the water collected and cleaned in the basin, and often warmed up on the slope, into the basin 8 located at the top of the course.

Figure 3:
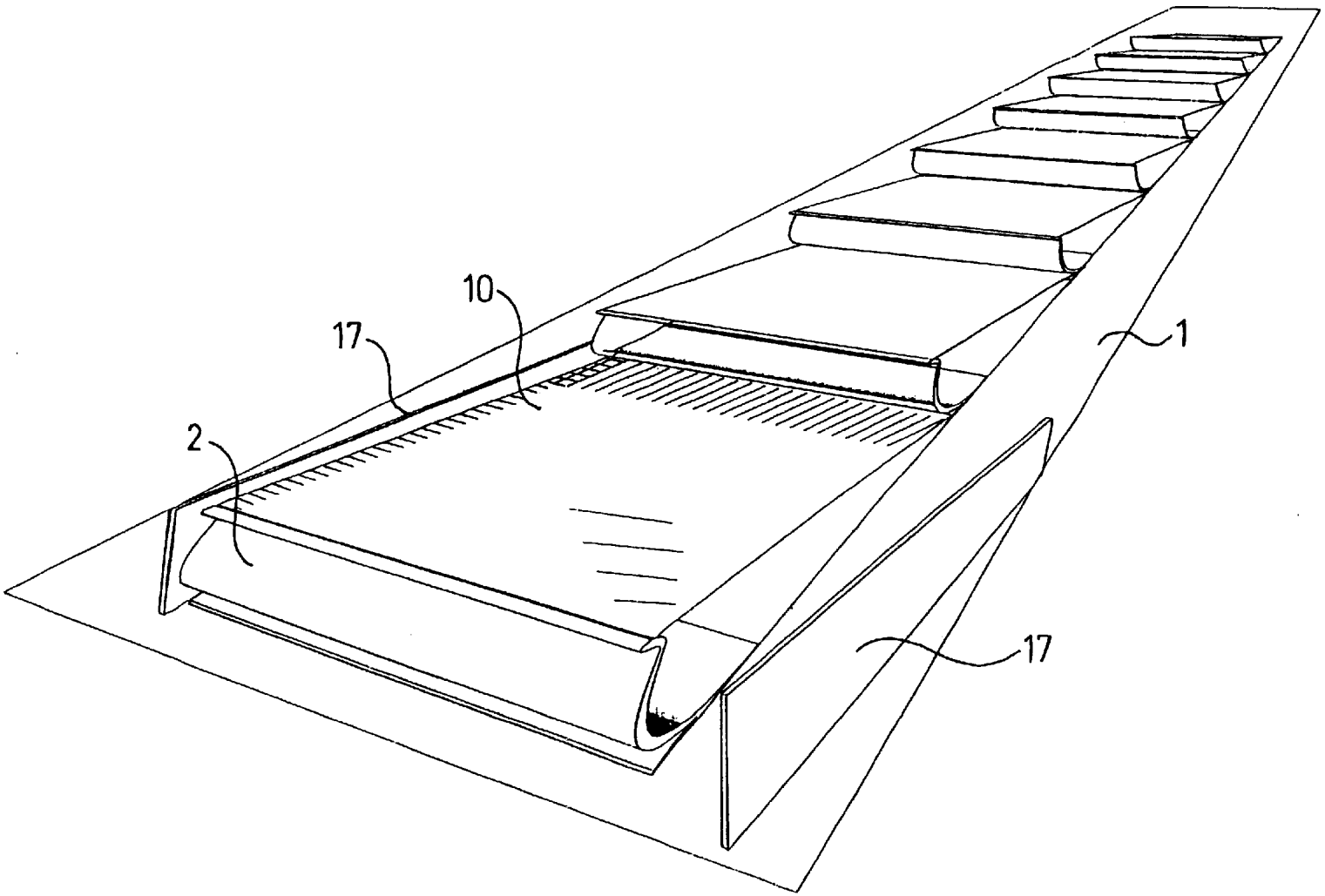
FIG. 3 is a site view of a strip cut from the sliding course.

FIG. 3 shows the structure of the sliding surface 1. The ribs 2 located on the sliding surface 1 are able to retain water in the space between them, that is, there is a pool 10 or micro-terrace between two adjacent ribs. These micro-terraces 10 must naturally be closed at their lateral sides or ends and this is solved by a length of a transverse or sectioning rib 17 abridging said ribs 2 with said sliding surface.

The micro-terraces 10 can be elongate pools bordered by flexible ribs 2 having suitable profiles and made of a suitable material, and extending along an approximately horizontal path, approximately perpendicular to the angle of the slope, and vertical sectioning ribs 17 limiting the lateral flow of water.

The micro-terraces must always be closed on the sides to prevent water from pouring out or limiting the outflow to the required rate. The water-filled space between two adjacent ribs 2, i. e. the micro-terrace must be interrupted by inserting vertical sectioning ribs 17 between the horizontal ribs according to the solution shown in FIG. 3, detailed later on the basis of the solution shown in FIG. 11, either by pasting or screwing them onto the upper covering sheet 5, (if necessary to the horizontal sections can be interrupted by pasting supplementary vertical sectioning ribs 17). This solution allows the safe use of creek-surfing in those surface sections of slopes covered by large underlay sheets manufactured economically in coils or boards, that deviate from the horizontal by intention or accident.

Figure 4:
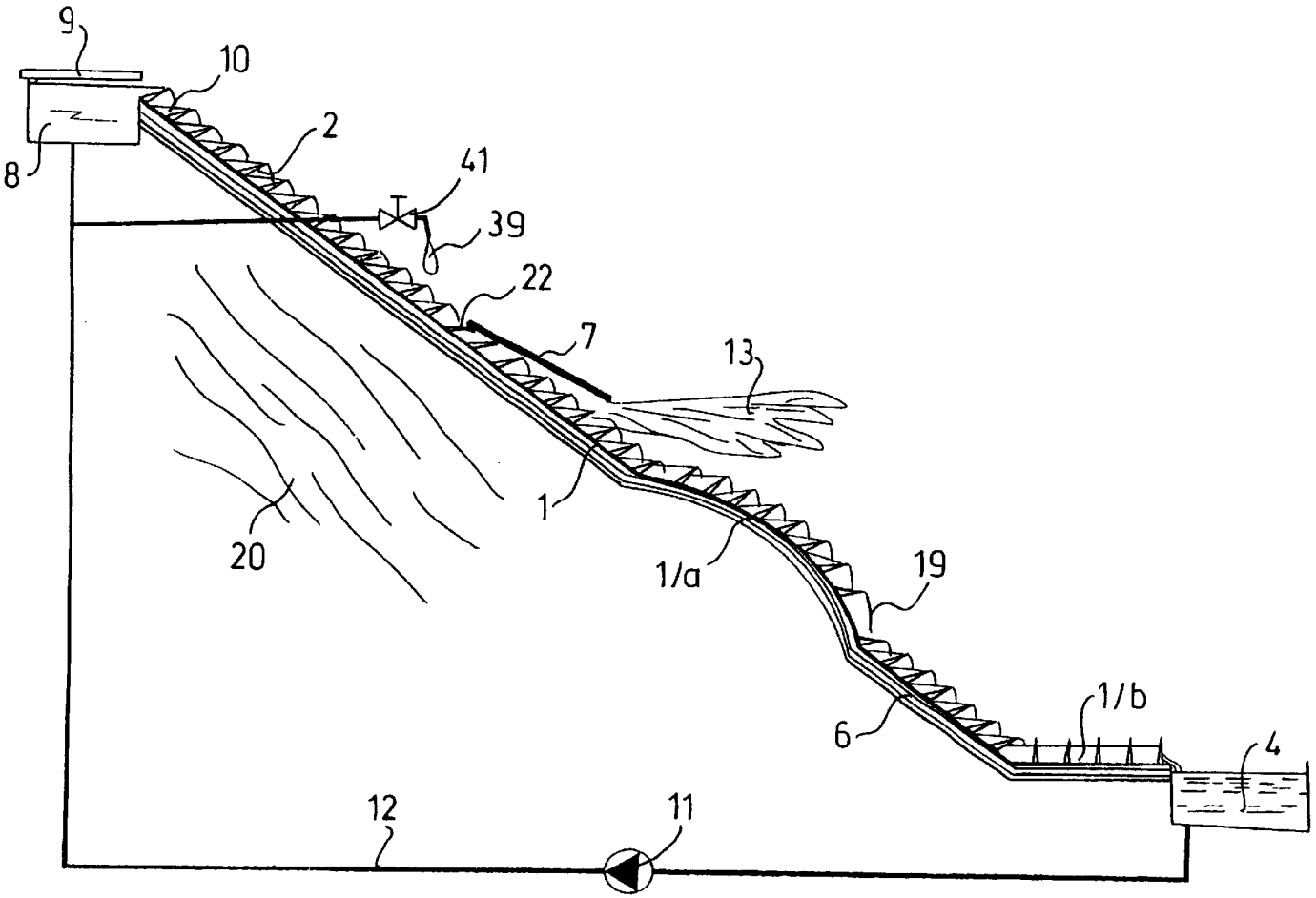
FIG. 4 is the schematic representation of the lateral section of the sliding course according to the invention.

FIG. 4. shows the structure of sliding surface 1 in a schematic sectional view. It is appreciated that the sliding surface 1 is placed on the surface created by the support surface 20, and the sliding surface 1 can have jumps 1*a* or raised sites too. The collecting basin 4 already referred to, is located at the bottom of the sliding surface 1, and is occasionally connected to the sliding surface 1 through the overrun surface 1*b*. The surface of the overrun 1*b* is horizontal or has a slight inclination. There is a underlay-plate 6 placed onto the support surface 20 to even out minor unevenness and to soften the course. The micro-terraces 10 formed by the ribs 2 are located there. The below the launching pad 9 located at the top of the slope there is an upper basin 8, which allows the continuous replacement of theater on the lower parts of the course should the pump 11 stop. The ribs 22 below the sliding device 7 placed on the sliding surface 1 bend and the dislodged water from there 13 runs off and spreads on the lower parts of the sliding surface 1. The continued feed and the dislodged water 13 forms a permanent overflow curtain 19, which if properly adjusted spreads evenly through the whole width of the sliding surface 1.

All sloping surfaces can be covered impermeably with a slippery material—preferably plastic—in such a manner that narrow pools, micro-terraces 10 are formed by ribs 2 protruding from the surface, and then water is let onto the surface at the top. The water will stop at the micro-terraces 10, and the flow will slow down form there on to such an extent than can be taken as approximately zero. The body sliding down in the slope covered in this way by water opens the way for the flow of water by bending the ribs (see FIG. 4.) and thus the surface becomes more slippery, and at the same time, the resultant of the reaction force of the dislodged water and the force required to bend the ribs is suitable to change the state of motion of the body (e.g. breaks, changes its direction). The ribs 2, due to their flexibility return to their original position soon after the body passed, forming once again micro-terraces that fill up with the permanently slow water flow and thus, the sliding surface 1 is almost immediately regenerated.

FIG. 4. shows the general theoretic scheme of the design of the course. The different elements can be left out as the case may be, and can be assembled into numerous variants.

The sliding surface is in all cases mounted onto a natural or constructed support surface 20. A support structure 20 is built onto the natural hillside after suitable preparation, and then the sliding surface 1 is fastened to it. In the absence of a natural hillside, the understructure is supported by a constructed support. In all cases the understructure must be made on the basis of and architectural static design. In the dimensioning the full filled-up water weight must be considered, as well as dynamic use and the changing load.

The pools, micro-terraces 10 formed by the ribs 2 built onto the sliding surface 1 in their normal state are filled with water and allow the run-off of a minimal water overflow 19 corresponding to the normal, base level water transport of the pump. The inclination of the sliding surface 1 is not always constant, it may have depressions and protrusions 1*a*, which might create hogbacks, making the slide more enjoyable. The course at its lower section has an overrun surface 1*b* a few meters long, with a very small inclination, which could be almost horizontal or even of negative inclination. The water flowing down gets into the basin 4. The job of the basin 4 is to store the water required to fill up the whole length of the course and replace water losses, to provide space for water circulation and cleaning.

The pump 11 placed in the inside of the basin 4 space or outside of it, conducts the water through the pipe 12 onto the basin 8 located at the top of the course. The yield of the pump must be regulated, this can be achieved either by using several pumps or through the electric or water side regulation of the pump. The yield of the pump depends on the lift of the course, the geometric dimensions, water contents, the time requirement for filling-up and the number of users.

The basin 8 ensures the even flow of water onto the course.

The basin 8 is covered by the launching pad 9 at the top of the course, from there the users can start without damaging the course.

In case of increasing the width of the sliding surface 1, or to replace water losses, additional water feeders 39 can be used in different sections of the course. Water feeders can have an important role at the start-up of the course, as starting the filling at several levels reduces the time required for the complete filling-up.

Sliding surface can be produced in any slopped surface with any of the surface making methods described below.

The material of the sliding surface 1 can be (poly) urethane-, PVC, KPE or other plastic, all UV stabilized, water resistant, without any water soluble paint or any hazardous material contents and it must be made of a wear resistant and elastic material.

The material of the ribs 2 can be (poly)urethane-, PVC, KPE or other plastic, all must be elastic, properly soft, UV stabilized, water resistant, without any water soluble paint or any hazardous material contents and it must be made of a wear resistant and elastic material.

The ribs 2 can be fixed securely in different ways, e.g. by pasting shaped fitting, joining clamped down with a fastening element the combination of the above.

The ribs as seen, can be structured in a variety of shapes and manners.

Figure 5:
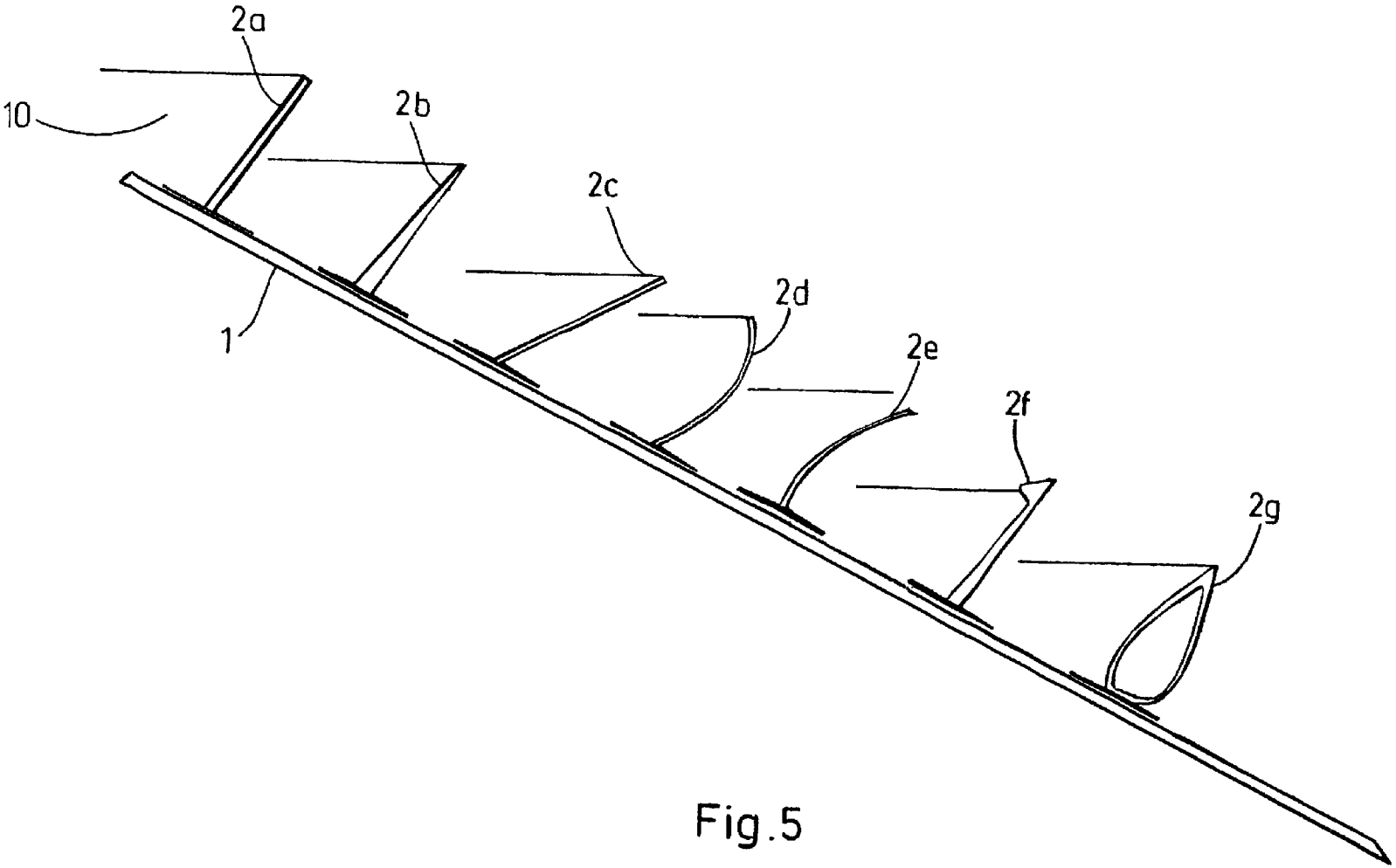
FIG. 5 is the schematic view of the section of different profile ribs used to make the sliding course according to the invention.

FIG. 5 shows the different version of the ribs placed onto the sliding surface 1. For all versions it can be said that the position could be reversed in comparison to the Figure, that is they can bend not only towards the direction of the slope, downwards, but upwards too, relative to the normal of the sliding surface 1. This could be useful for instance for the lift 33, where the suitably constructed and positioned ribs can bend upward when the person proceeds upwards on the slope, sliding up with the aid of two sliding devices.

The shapes of the ribs 2:

2/*a* horizontal rib, straight: is a rib perpendicular to the inclination line of the course made with a protrusion angle not deviating from it by more than +10 deg.

2/*b* horizontal rib uniform strength: identical tension is created through the whole cross-section of the rib

2/*c* horizontal rib straight forward bending: ensures soft track characteristic, bending more easily at the arrival of the user, the course is more slippery. The angle of its position is more than +10 degree from the perpendicular, but without being horizontal. Mounting this rib in the opposite sense a backward bending rib is achieved, making the course harder, it is more difficult to use, but at the same time more enjoyable.

2/*d* horizontal rib curving backwards: combines the softness of the forward bending rib with the relatively large water space, and allows pasted or painted promotional material to be placed on the valley-side surface.

2/*e* horizontal rib curving forward: An even softer track characteristic than the straight forward bending rib.

2/*f* horizontal rib with a stiffening profile: the rounded stiffening profile helps fast return to the original position, and protects the first user from damages caused by the thin profile edges. The stiffening profile placed on the hillside helps stopping providing shaped resistance.

2/*g* horizontal rib with cavernous inside profile: the air sacks can have an advantageous effect on the flexibility of the ribs. The sliding course can be made even more pleasant if the cavernous internal rib profile 2/*g* according to FIG. 5 is used in such a manner that the caverns inside the ribs are closed, connected to each other and to a regulated power compressor, than the pressure of the enclosed air is varied. As a result the character of the course changes significantly, becoming harder as the pressure increases.

2/*h* horizontal rib with grooved surface (FIG. 9): the cross grooving of the ribs 2 improves significantly the friction across the axis of the course, improving the possibility of turning. The depth of the grooves is 1–10 mm, the width is 5–20 mm.

2/multi covering sheet including several ribs (FIG. 14): the manufacture of the ribs 2 with the covering 5 accelerates site mounting. It is not necessary to pay attention to the horizontal assembly, water tightness is ensured without it. The 2/*m* covering sheets are placed over each other with overlap, then they are fastened relative to the slope and pasted together.

rib 2/*z* structured in a similar manner than the slates or shingles used for roofing (FIG. 13), it has an upward bend along one side forming a rib 2/*z* and a partial upward bend on two adjoining sides and represents thereby a genarally rectangular course covering element, These elements are positioned on the surface with a mutual overlap in the way as roofing tiles are laid on a roof Its advantage is its almost complete insensitivity to horizontal assembly, completely different course surfaces resembling spatial curves can be covered with it. The lower section can even be curved, but the tree sides melting together can form a spoon, concave spatulate or slipper-like element, respectively. The full lower surface of the slate-like rib is pasted, thus the water tightness of the sliding surface 1 is guaranteed. On the lower side of the micro-terraces water passages and overflow bores are made.

All of the forms described above can be combined with any of the fastening methods.

Figure 6:
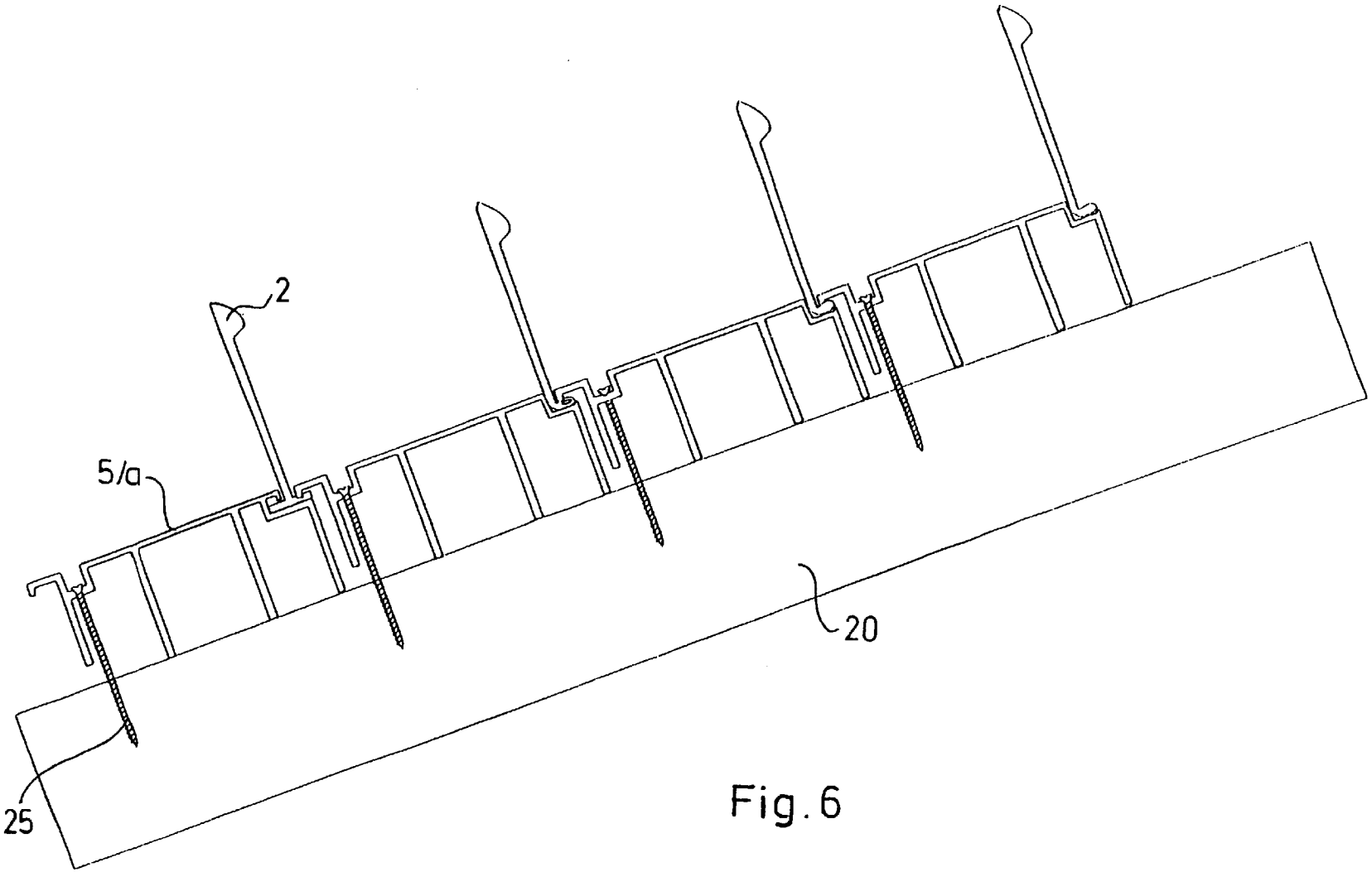
FIG. 6 is the sectional representation of the sliding course according to the invention constructed with self-supported covering sheet.

FIG. 6 shows a version of the sliding surface 1 where the ribs join self-supporting cover sheet 5*a* equipped with stiffening ribs. The covering sheet 5*a* is structured by bands and affixed to the supporting surface 20 by screws. In this case bolsters too can act as or replace a supporting surface 20. The bands of the covering sheet 5*a* can be fastened to the supporting surface 20 with the aid of fastening elements 25 for instance screws.

FIG. 6 shows one of the most obvious methods for the construction of the course. The course is made of plastic profile covering sheet 5a made specially for this purpose, which overlapping and fastened in a base-board-like manner fastens at the same time the horizontal ribs placed between them. The upper part of the plastic profile is smooth, while on the bottom is equipped with ribs of such height and strength that guarantee stable sliding surface even is the support is located at 60–120 cm. Fastening is ensured by the fastening elements 25 made in the form of screws and sunk into the base structure forming the supporting surface. Water tightness too, is basically ensured by the entire bottom part of the rib 2 and the upper hillside of the base being filled without gap with adhesive-seal. In this way the course is self-supporting, the assembly time is reduced, the replacement of the elements is fast and simple. With the utilization of this solution it is sufficient to have the base structure consist of bolsters.

The ribs 2 forming the micro-terraces 10 of the course joint the covering sheet 5 with shaped fitting. Their shape is chosen based on the use of the course. The angular offset of the ribs 2, their frequency and shape can change, always in order to achieve the desired results.

Figure 7:
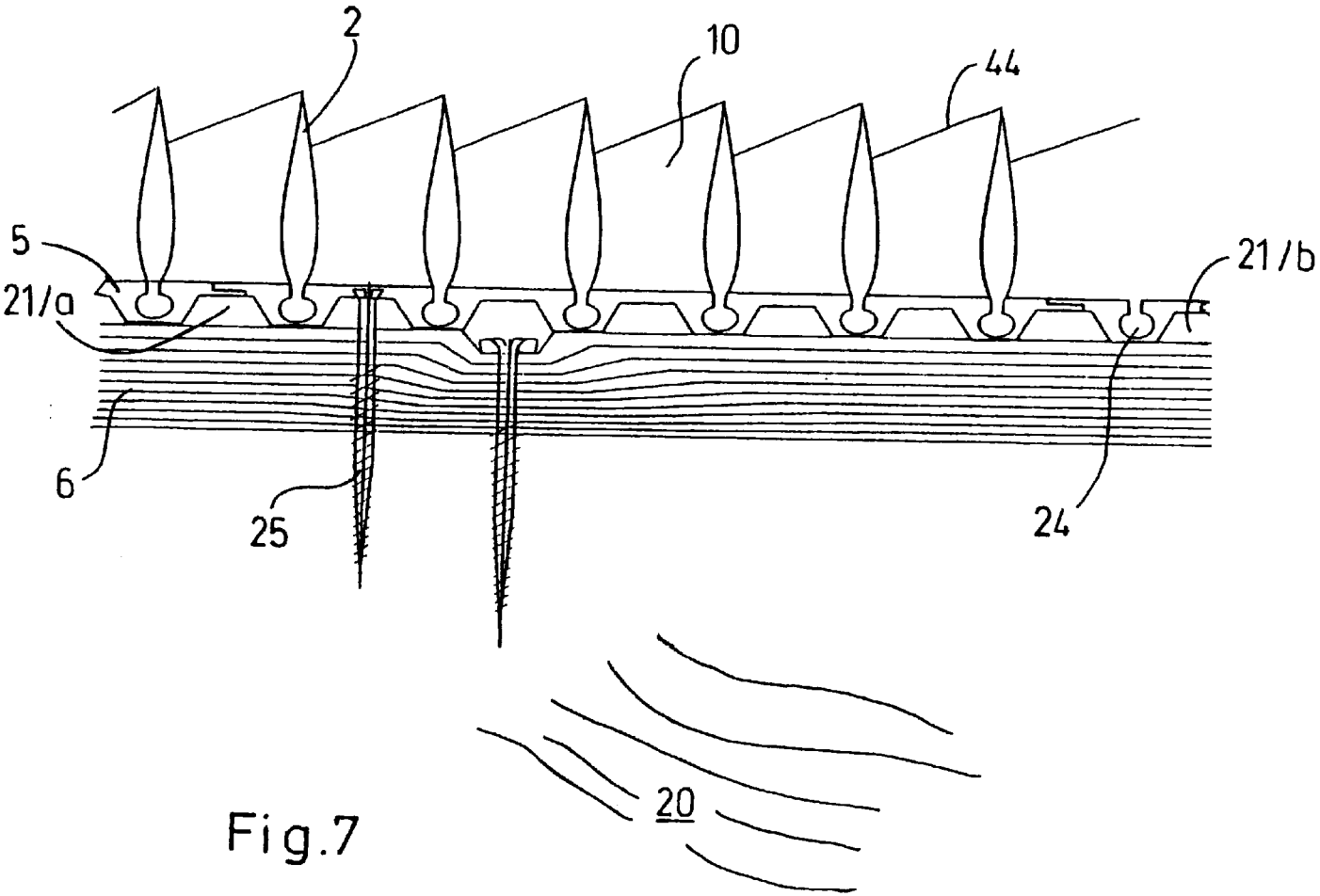
FIG. 7 is the sectional representation of the sliding.course constructed with screwed-on underlay-plates and screwed-on covering sheet and the ribs hitched to it.

FIG. 7 shows the use of a cover sheet 5 made of flexible material, on which there are notches narrower than the surface and widening inside. On the side of the ribs 2 connecting to the covering sheet 5 there is a beading that fits into the notches. The covering sheet 5*a* is indirectly fastened to the supporting surface 20 through the underlay-plate 6. Both the covering sheet 5 and the underlay-plate 6 are for instance affixed with the aid of fastening elements 25 made in the form of screws. The covering sheet 5 thickens at the notches 24 and thus the whole surface becomes more flexible. The covering sheet 5 can be made of bands and the bands join together sidewise with connecting surfaces 21*a*.

Figure 8:
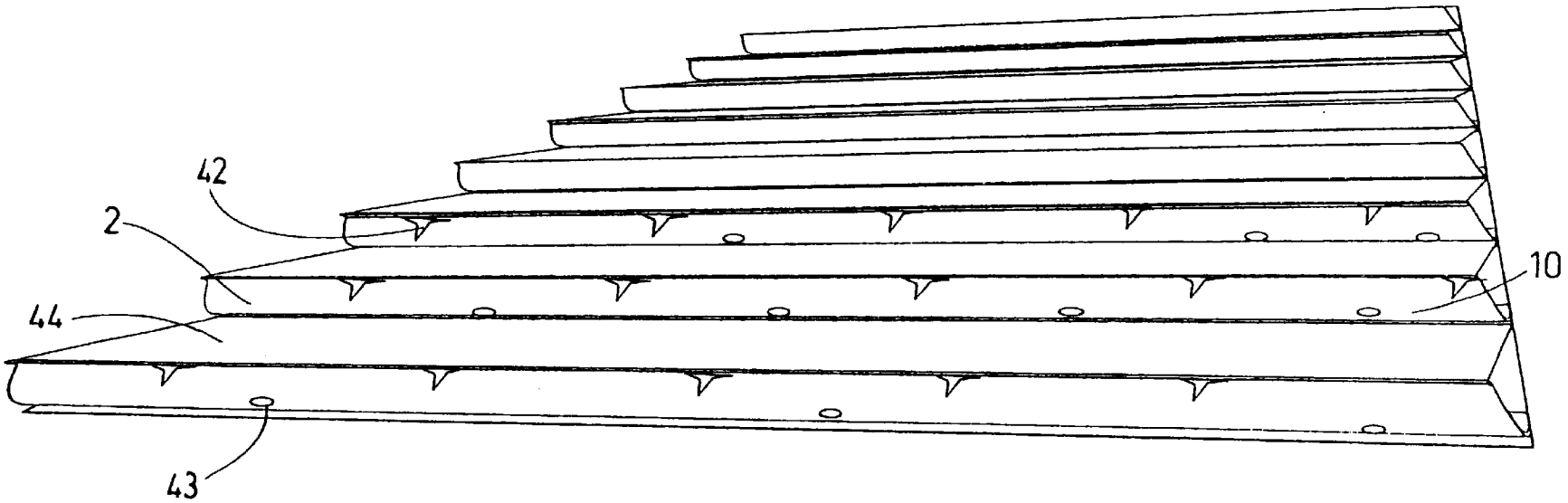
FIG. 8 shows an overall picture of the version of sliding course according to the invention constructed with horizontally placed ribs, with the overflow depressions and water leak bores.

FIG. 8 shows how is it possible to make the spreading of the water even along the width of the sliding surface 1. Probably the upper edge of the ribs 2 is not exactly horizontal. Probably the strength of the ribs 2 also is not even along their fill length. At the same time the ribs 2 are easy to bend to allow the sliding device 7 to bend the easily. For this reason it can happen that as a result of the pressure of the water contained within, the first edge of the rib 2 is located lower at certain places than at others, and so the water retained by it will seep down at this place onto the micro-terrace formed by the rib 2 below it. In unfavorable cases such seeping occur at the edge of the course, or are distributed unevenly along the width of the course, and thus, a small rivulet can form on the sliding surface 1. It is better if such an overflow is not caused by a slipover extending to the full length, but depressions 42 of smaller width are made intentionally, which form an overflow slit, and make the flow of the water to the water surface below 44 more even. Water passage bores 43 must be made on the ribs 2 too, which could have two roles. One of the roles is that they allow the draining of the water in case of cleaning or stoppage. The other role is that making such bores 43 subsequently or adjusting them can make the water flowpnore even during operation.

For the installations exposed to freezes in winter it is necessary to ensure the drainage of the water. For this purpose water passage bores 43 are formed at the lowest part of the water filled pond of the micro-terraces 10 and made after assembly are extremely suitable, as the bores located at the bottom of micro-terraces 10 can be considered as serially connecting an upstream pond with a downstream pond, and thus the total loss of water can be linmited to the water volume passing through all bores 43 located along a singe horizontal rib.

Overflows can be formed on the top of the horizontal ribs. The overflows are small slits made in the material of the ribs, through which the water contained in the basin can drain away before reaching the lowest point of the upper edge of the horizontal rib. Their total cross-section is only slightly less than the flow cross-section of the freely flowing water, thus they cause swells within the micro-terraces. The water mass of the micro-terrace will start to drain away before the complete filling-up through the slipovers 42 and the water passages 43 a making streaming down of water more even. Their users justified for large (especially wide) courses.

It is a basic requirement for the vertical sectioning ribs 17 is that they must allow that the horizontal ribs to flexibly bend, while providing adequate water tightness after recovery. The sectioning or transverse elements cut to size at the assembly site can be made of the same material as the ribs 2 and screwed or pasted to the sliding surface 1 thereby these requirements are fully met. It is however necessary ensure that pasting involves only the sliding surface 1.

Figure 9:
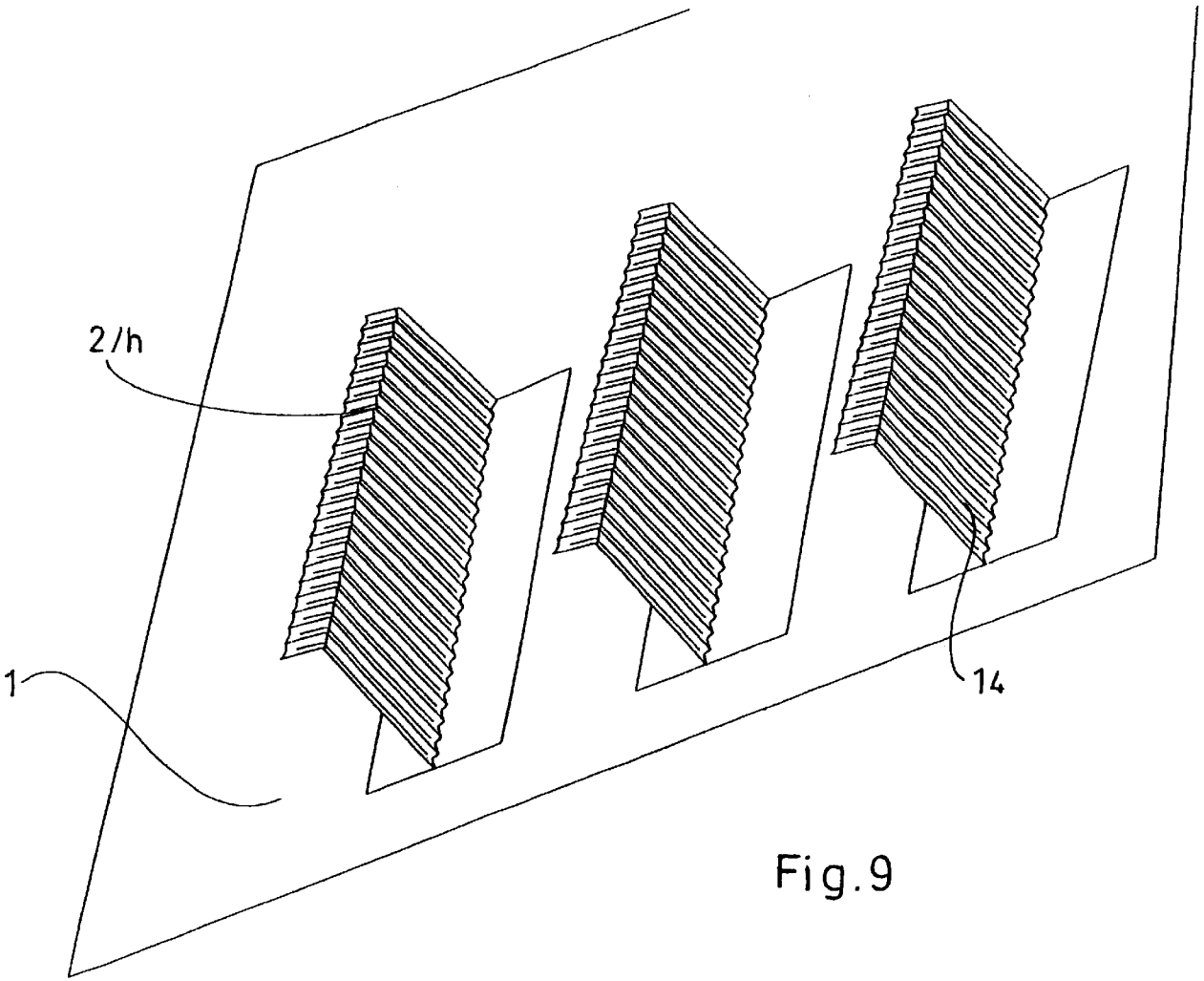
FIG. 9 is an overall picture of a part of the sliding course constructed with ribs having grooves on their surface.

FIG. 9 shows a sliding surface where there are 2*h* ribs with grooves.

Figure 10:
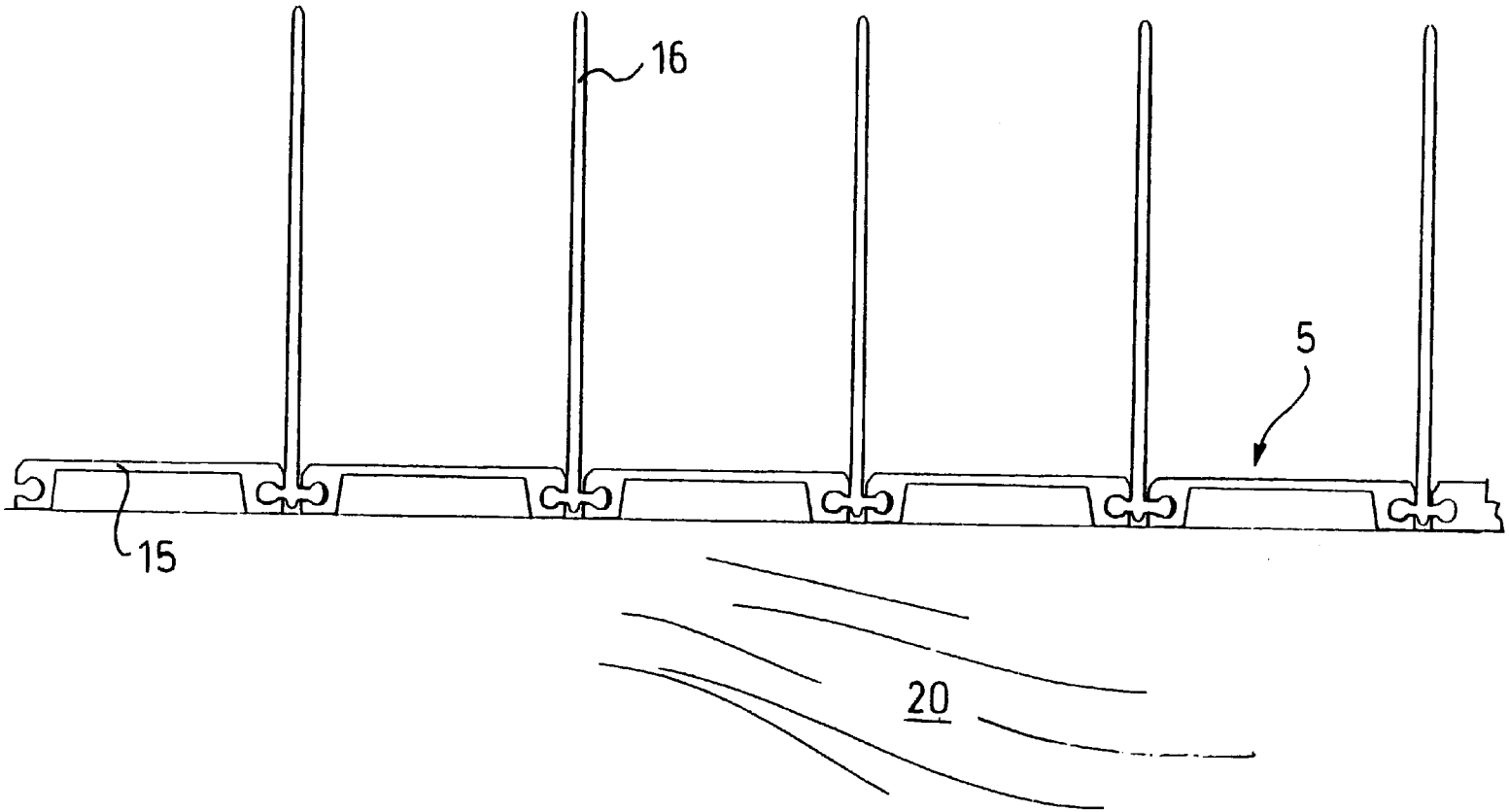
FIG. 10 is the sectional representation of a part of the sliding course according to the invention where the covering sheet is made of strips having connecting elements, with the strips being held together by ribs connecting into the connecting elements.

FIG. 10 shows a solution similar to that on FIG. 7, where the covering sheet 5 is made of bands 15, but in this case the bands 15 are relatively narrow and there is a rib 16 between two adjacent bands 15. Both the edge of the bands 15 and the root of the ribs 16 are equipped with connecting elements. The ribs 16 have two connecting elements each and these each connects to a band 15 fastening two adjacent bands 15 together.

In implementations where the surface is not even, and its geometry cannot be described by a cylinder-jacket due to nature or intentionally, the use of long horizontal ribs is not satisfactory. In such cases systems made up of discrete micro-terraces 10 must be used (FIGS. 11, 12, 13*a*, 13*b*), which basically represents the version of the micro-terrace system broken into short elemental sections. Such other methods of forming micro-terraces are also possible, (FIG. 11) e.g. systems made up of discrete micro-terraces formed in a honeycomb or rhomboidal (FIG. 12), or slated (FIGS. 13*a*, 13*b*) manner. In this way it is possible to construct courses of complex geometric design.

Figure 11:
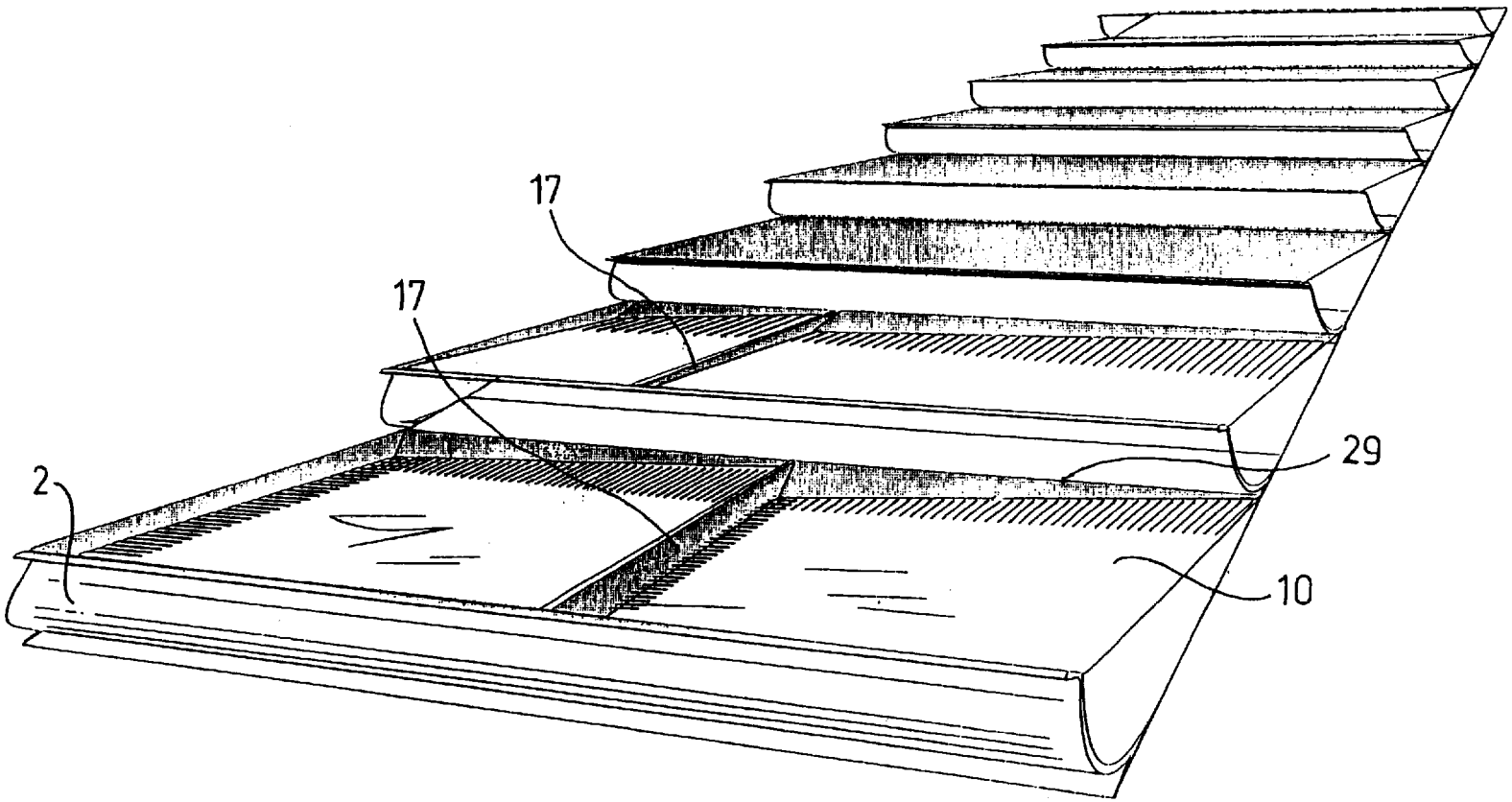
FIG. 11 is a section of the sliding course constructed with ribs not fully horizontal, with micro-terraces divided into sections by sectioning grooves.

FIG. 11 shows a version where the fibs 2 are not fully horizontal. This means that the micro-terrace between the ribs also is not horizontal. This however, would be impossible, as the surface of the water 29 in the micro-terrace is always horizontal. Thus, in order to prevent lateral flow there are sectioning ribs 17 placed between two adjacent ribs 2, which can be identical to the ribs 17 closing the ends of the micro-terraces 10. As shown in the Figure it is preferred to locate the ribs 17 are not exactly below each other but in laterally offset position. This allows water to flow down from each micro-terrace 10 onto two downstream micro-terraces 10 positioned below it. Thus, overflow slit 42 and water passage bore 43 can be made separately in each micro-terrace 10 and even two overflow slits and two water passage bores can be made on each of them and even their size can be different. With a suitable adjustment of their number and size the uneven flow rates of the water can be compensated while or after installing the course.

Figure 12:
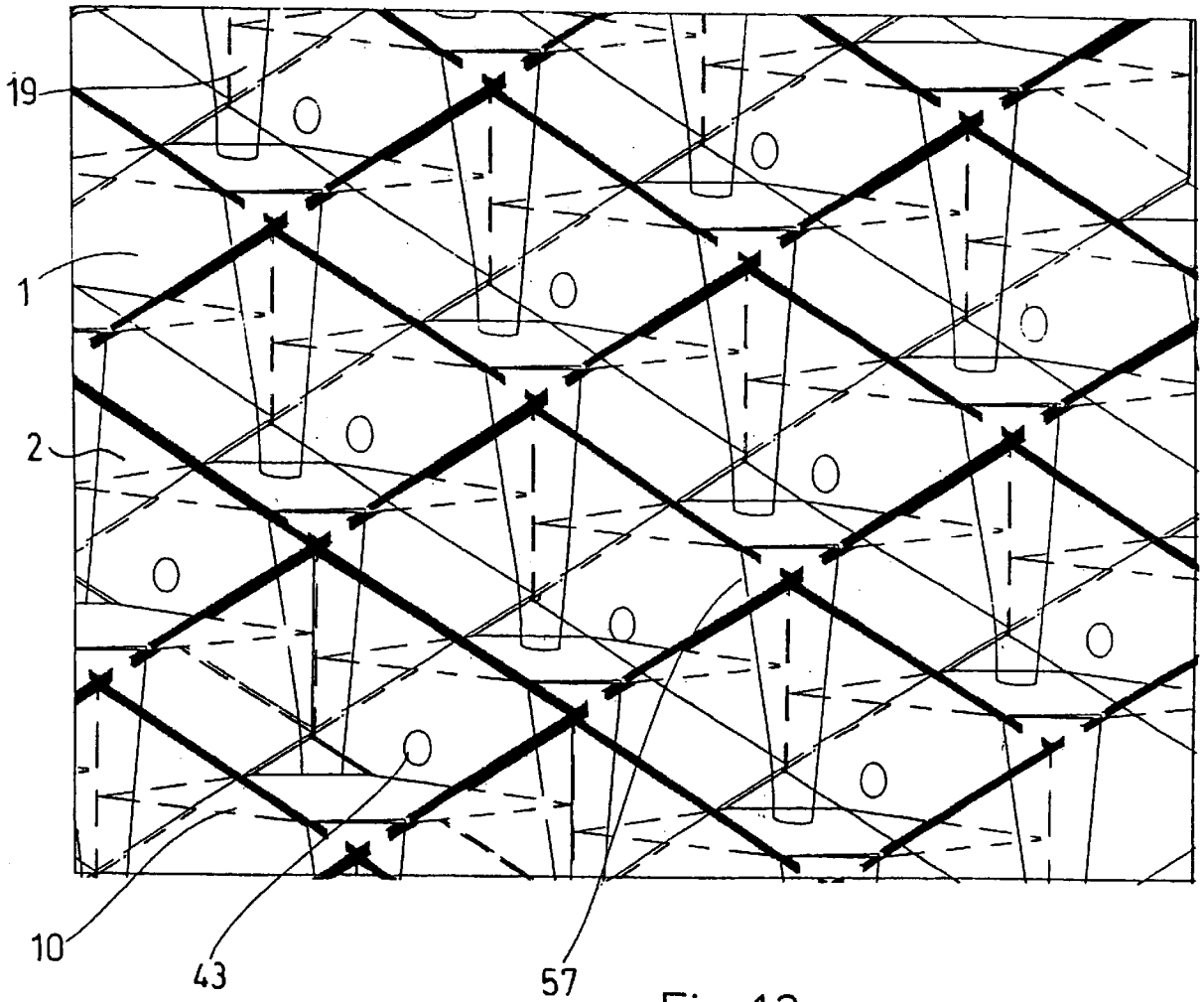
FIG. 12 is a section of the sliding course constructed with crossing ribs.

The micro-terraces 10 made by two crossing ribs 2 shown in FIG. 12 are already equipped with defined overflow slit and thus, they need not be made. Here the water passage bores 43 provide opportunity for adjustment, and they are the primary resources for solving unevenness. The water flow 19 running off from a micro-terrace 10 mainly stream only into another one of the micro-terraces 10.

Figure 13A:
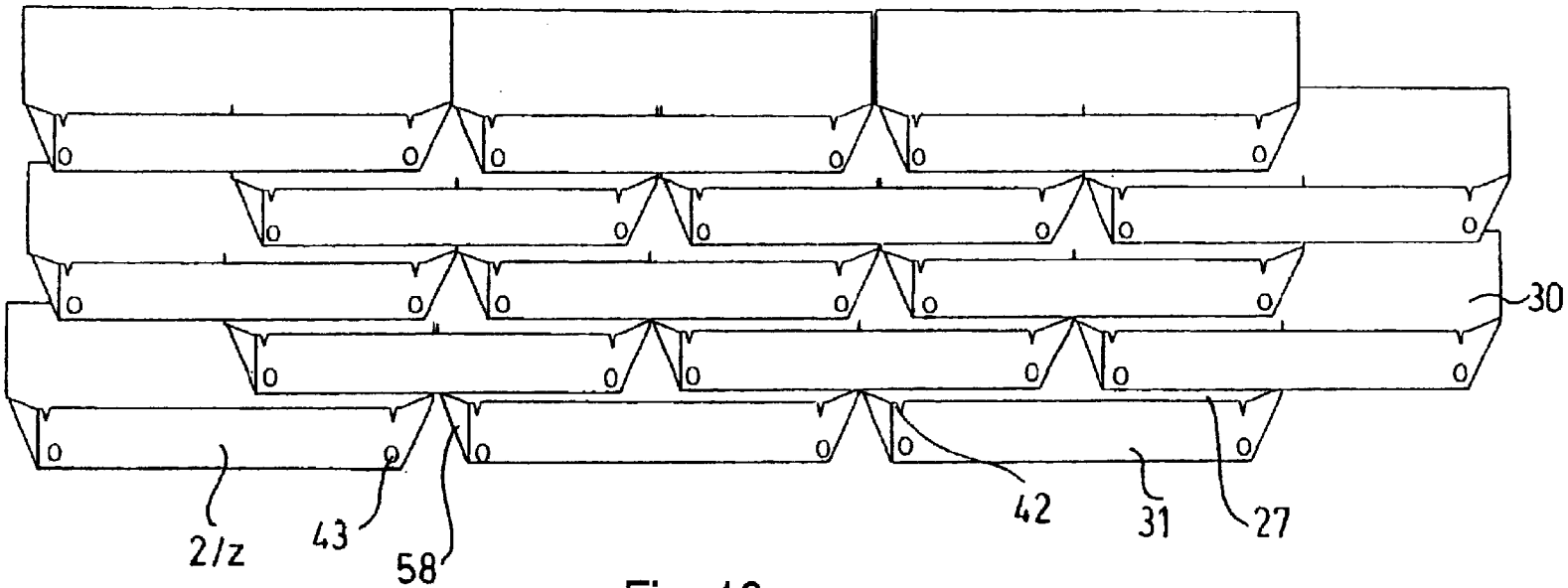
FIG. 13*a* is the front view of the sliding course constructed with a slope covered with discrete covering elements.
Figure 13B:
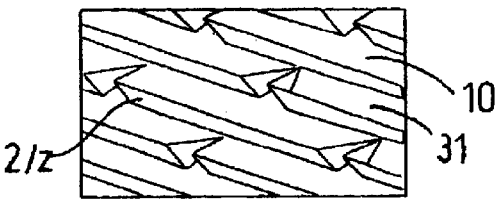
FIG. 13*b* is an overall view of one of its details.

FIG. 13*a* shows the sliding surface 1 made up of discrete covering elements. The covering element 27 comprises basically of a flat covering sheet 30 and a pond or basin 31 made at its end. The covering element 27 must be placed in such a manner onto the slope that the basin 31 is at the bottom The basin 31 is bordered by the covering element 30 and the 2*v* rib connected to the lower edge of the covering sheet 30, the basin 31 formed this way is closed on the sides by sectioning ribs 57. These covering elements 27 can simply be mounted individually onto the slope, for instance using additionally an underlay-plate 6, with the aid of screws or nails or other fastening elements, or adhesive or both. The placing of the covering elements 27 must start at the bottom of the slope with the same technique as for roofing, and continued upwards. The top covering element 27 must be placed on the covering element 27 below in such a manner that the lateral juncture of adjacent covering elements 27 should be covered overlapped by the covering element 27 next above. In this overlapped state water tightness can be achieved in a manner similar to roofing without any additional measures. To have adequate water tightness the covering sheet 30 of the covering element 27 must be 2–3 times longer than the length of the basin 31. These dimensions are understood along the direction of slope.

Figure 14:
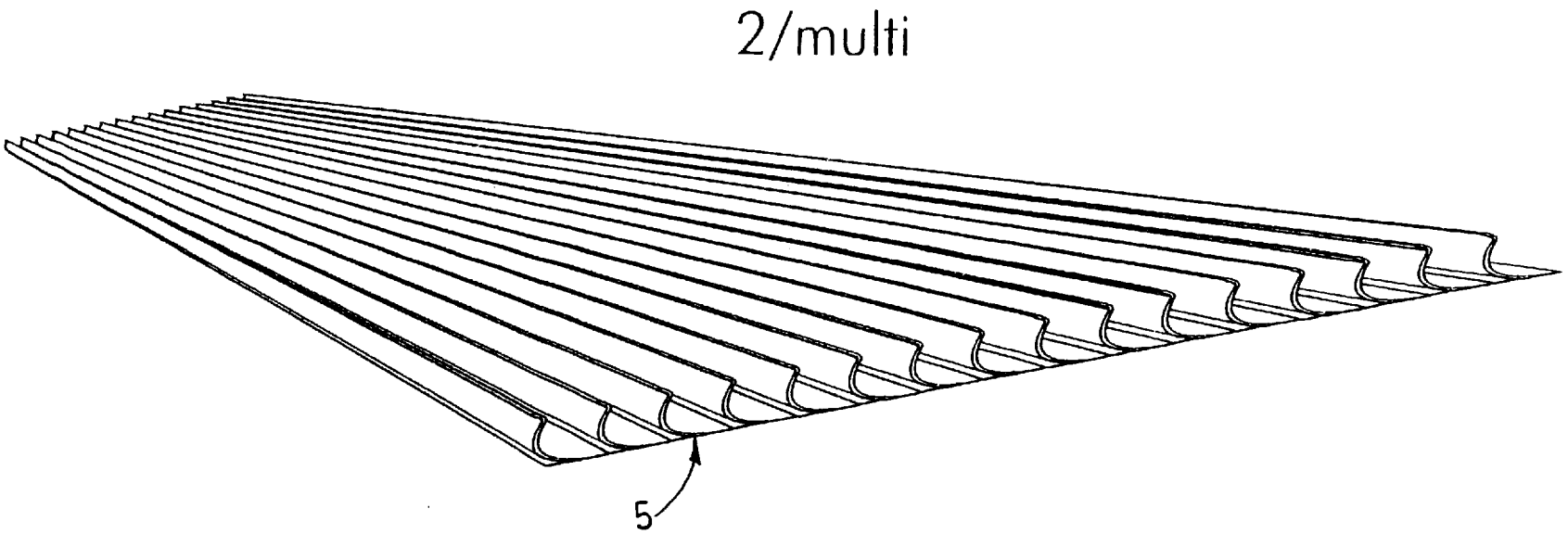
FIG. 14 is a version of the covering sheet used for making the sliding course which can be manufactured by extrusion, with integrated ribs.

FIG. 14 shows a prefabricated covering sheet 5, where the multi-ribs 2 come factory made. This can be achieved with extrusion or line welding. The covering sheet 5 manufactured this way can be rolled-up in the form of a carpet since the material is flexible.

This is a significantly simplified version, but due to the cost reduction effect, the combined rib 2/multi plays a non negligible role, because the covering sheet 5 and at least two pieces of horizontal ribs 2 are factory mounted, the micro-terraces being co-extruded from different quality materials onto a T shape or assembled separately and are manufactured in a single work phase with the covering sheet. The foot-type ribs must be pasted close together with an adhesive layer deposited onto their bottom surface (e.g. according to FIG. 5 with the adhesive layer shown for rib 2*e*) to the bolster prepared in advance (the precondition here is that the upper surface of the bottom bolster be suitable for pasting, i.e. equipped with a plastic sheet pasted to it), making this way a monolithic covering sheet 5 with horizontal rib 2. (See later the description of FIG. 16). An additional advantage of using foot-type ribs is that in certain cases one of the foot-type ribs 2*a*–2*f*, 2*h* is suitable without any changes to perform the tasks of the vertical sectioning rib 17 (being perhaps cut to size at the site). The surface unevenness caused by the shoulders of the slope can easily be corrected with the longitudinal cut of the feet of the ribs or by leaving a spline-like indentation, and it is easy to set the ribs 2 as horizontal as possible.

The sliding devices used for skiing can be used on the sliding course. Both ski and snowboard are suitable for sliding down if their slipperiness is adjusted and their very sharp steel edges made for snow are rounded down.

To enjoy in full the possibilities inherent in the sliding course a sliding device similar to the snowboard developed specifically for the purpose can be used. The device fastening the feet of the user can be rather simple, or more complex, which enhances safety causing very little discomfort. FIGS. 15*a*–*g* show a sliding device similar in design to the snowboard. It can be used with special shoes 35, which protects the feet 37 of the user from bruises. The shoes 35 are similar to those used for surfing, skiing, snowboarding, but most of all to those used for roller-skating, and are made of aerated, strong, or even completely rigid, water resistant material.

There are bridles 34 on the sliding device 7 to accommodate the shoes 35. The sliding device 7 can be a plane sheet by both the front and the end can be bent upwards to a small extent. Both longitudinal ends of the sliding device 7 are suitably rounded. The edges of the sliding device 7 also can be rounded, excessive rounding however reduces direction control. If suitable material is used the edges can be made angular too.

Figure 16A:
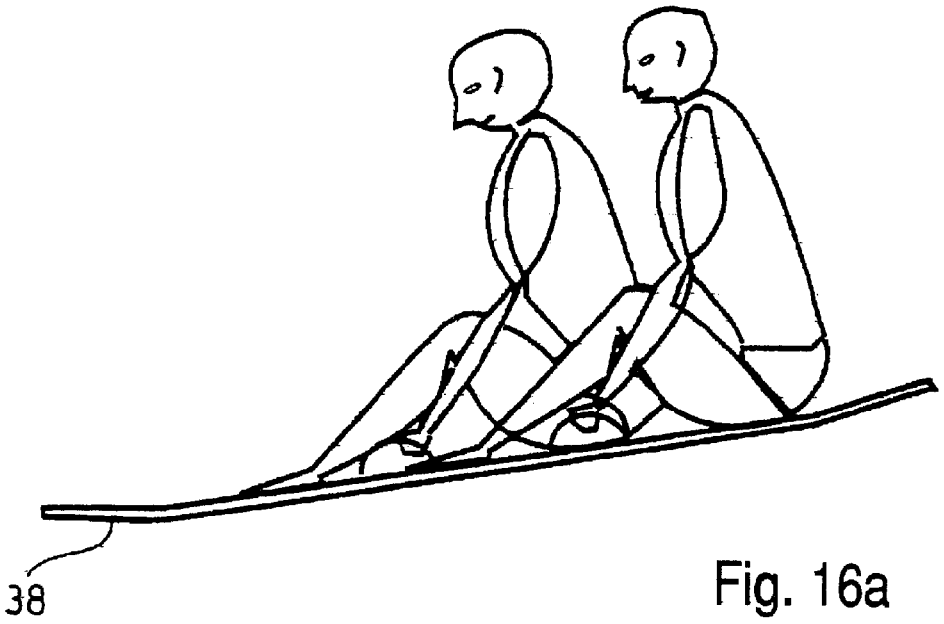
FIGS. 16*a* and 16*b* illustrate a simple version of sliding device similar to the sleigh, which can be used, on the sliding course according to the invention.
Figure 16B:
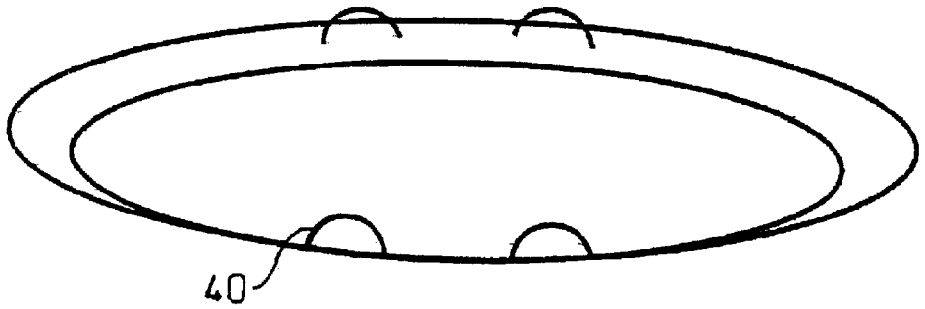

FIGS. 16*a,* 16*b* show a sleigh like sliding device 38, which can accommodate two people even; and is equipped with a grip 40 to prevent falling down.

It is possible to slide down alone or in groups with the sleight-like board sliding device 38. The sliding device has one or multiple layers, of a plastic, water resistant material, has a flat structure resembling a flying saucer, and one or more persons can sit thereon. While sliding down they can hold the grip 40 and can control the direction of movement by the relocating their body weight. This sliding device 38 can be steered by extending feet just us in case of sliding down by a sleigh.

A sleigh board can be braked with the aid of the breaks described for the rubber boat. As sliding device 38 is less steereable than sliding device 7, their simultaneous use in the sliding course is not recommended.

Figure 17A:
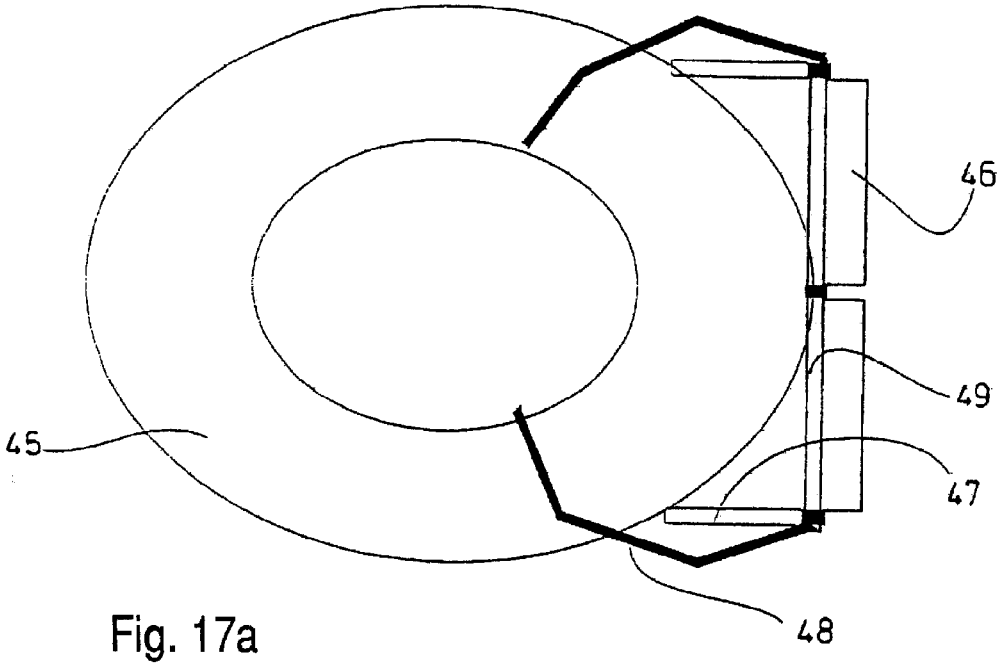
FIGS. 17*a* and 17*b* are the upper view and side view of a steerable version of the sliding device made in the form of a rubber boat, which can be used on the sliding course according to the invention.
Figure 17B:
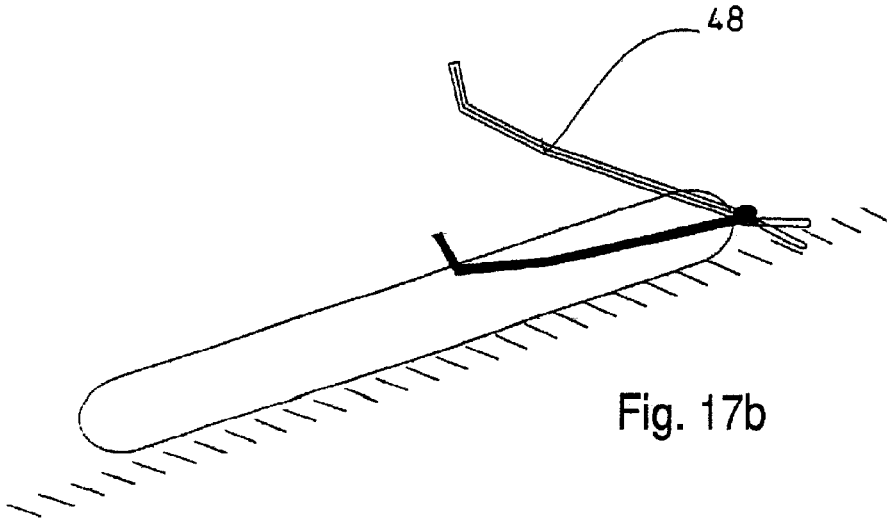

An additional possibility for group sliding is the special steerable rubber boat (FIGS. 17*a,* 17*b* and 18). The difference in comparison to an inflatable plastic or rubber boat is that the bottom 51 is stiffened and is equipped longitudinally with ribs, and instead of the oars, braking oars or members 46 can be mounted permanently or temporarily onto it. The braking oars can be in the front or in the back, and always the persons sitting in the boats are those who handle them. The braking oars can be moved separately from each other. If the persons in the boat press the oar on one side using the braking arm and push it against the sliding surface 1 the symmetry of the boat gets broken, its state of balance changes and a strong backward force develops turning the boat towards the braked side. The ribs made on the bottom of the boat ensure that the direction is kept, that is, that the boat move towards the direction of least resistance, and that moving in directions perpendicular to it is made harder.

FIG. 17*a* shows a sliding device 45 similar to a rubber boat. There is a pair of oars 46 affixed to one of its ends fastened with the aid of a fastening device 47. There is an arm 48 linked to the oars 46 with the aid of which the oars 46 can be turned around the axis 49. When lifting the arm 48 the oar 46 is pressed against the sliding surface 1 and by exercising a break effect it serves to steer the sliding device. To improve steering, ribs should be made on the bottom of the sliding device 45.

Figure 18:
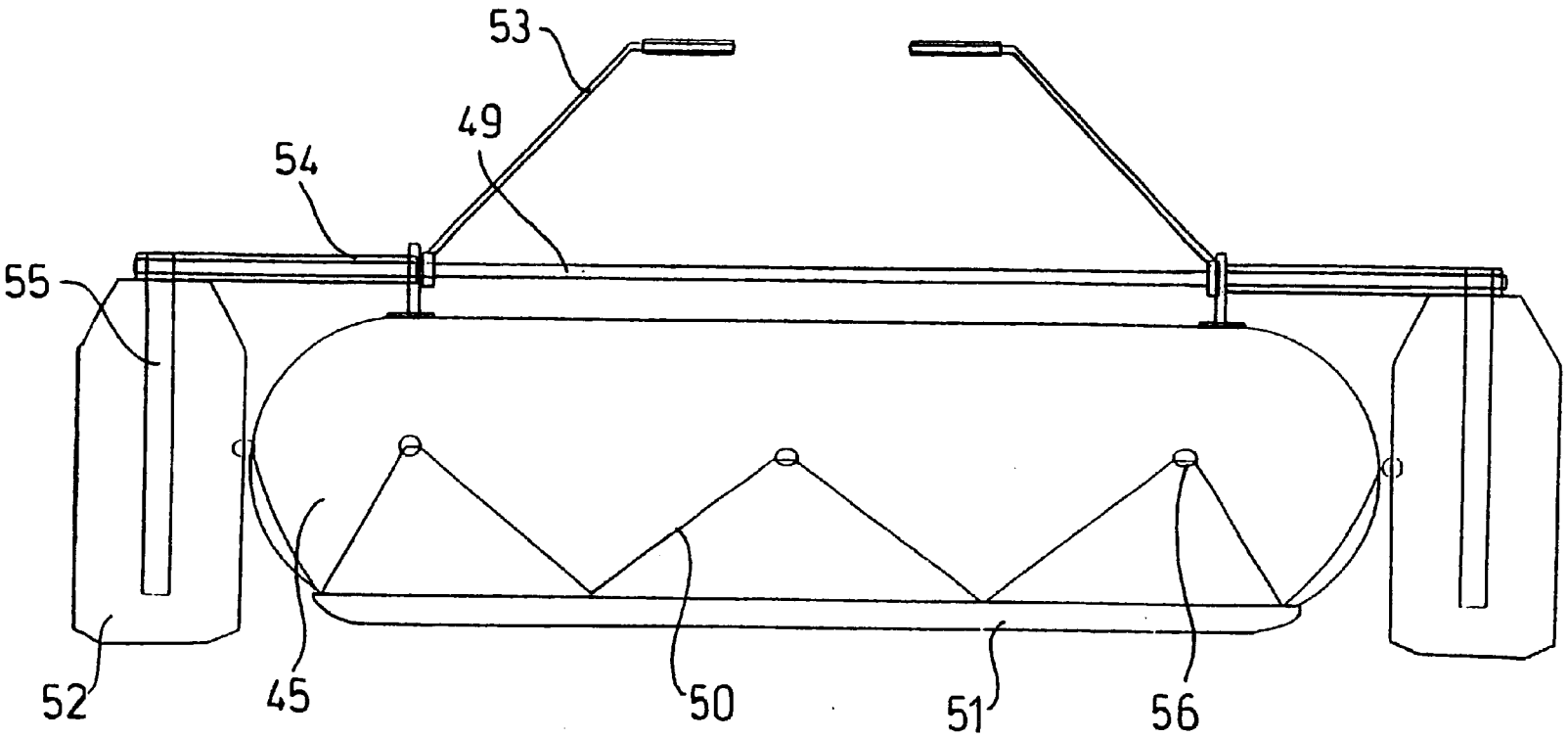
FIG. 18 is the front view of a steerable version of the sliding device made in the form of a rubber boat, which can be used on the sliding course according to the invention.

FIG. 18 shows the version of the sliding device 45 made from a rubber boat, on the bottom of which there is a sheet 51 affixed with the aid of a rope 50. The sheet 51 is suitably shaped in the form of a tray ribbed on the bottom side. This sheet 51 can be affixed with the aid of the rope 50 to the rope eyelets 56 of the rubber boat serving as core fore the sliding device 45. The sliding device 45 is further equipped with oars 52 affixed in pairs, which are fastened to an axle tube 54 through a brace.

The sheet 51 that forms the rigid plastic sliding surface to be mounted on the bottom of the commercially available rubber boat is fastened to the eyelets on the sides of the boat with the rope 50 affixed to its side. The rudders on the two sides of the boat are linked by an axis 49 passed through the rudder fastening axle tube placed into the oar ring of the boat where it can turn. The boat side rudder fastening axle tube 54 cannot escape form the oar ring and thus it positions the rudders. The end of the axle tube opposite to the boat is affixed to the axis 49 in a manner that makes turning possible. The rudder 55 is rigidly affixed to the axle tube 54 (by welding or with separable connection) with a stiffening element or steel sheet. Its role is to make the plastic rudder resistant against the significant steering forces The rudders and braking arms are mounted on the axle tube at an angle at which in a stationary state the rudders point upwards and the braking arms are pushed forward. When the braking arms are pulled back the rudders are pressed into the sliding surface 1, they bend down the ribs 2 creating significant friction. The user pulls one of the pair of braking arms 53 welded to the axle tube in accordance with the desired change of direction and as a result the rudders are pressed separately or for braking simultaneously against the sliding surface 1, where the created friction breaks the rudder changing the state of motion of the boat. The longitudinal ribs on the bottom of the boat stabilize the changed direction.

With this additional fixtures the mass-produced rubber boats available commercially can be simply used.

The physical principle of steered boat slide is based in a smaller part on the reaction force of the water, and in a greater part on the shape resistance of the ribs.

Figure 19:
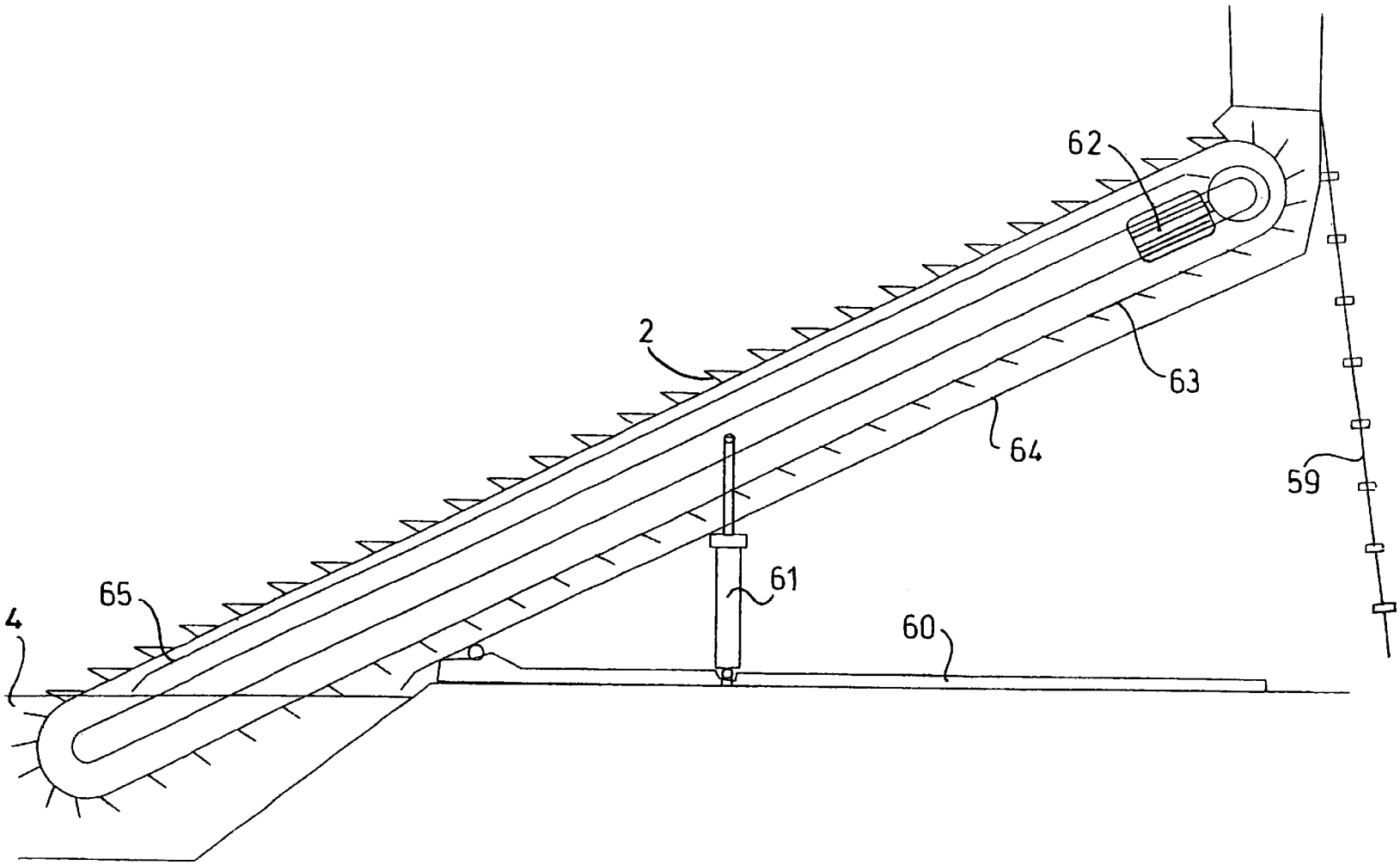
FIG. 19 is the schematic side view of the continuous version of the sliding course according to the invention.

One of the special areas of utilization of the sliding surface 1 shown in FIG. 19 is the mobile slide. This is an equipment resembling a conveyor belt, with the horizontal ribs 2 and the side sectioning ribs 17 forming the micro-terraces 10 being mounted onto a wide conveyor belt 63 (as wide as 3–20 meters). The conveyor belt 63 is driven by a driving motor 62 with a suitable gear, with the driving speed being variable to allow adjustment to the optimum speed. The conveyor belt 63 is dragged almost on its total width upon and along a stationary supporting surface 65 which provides support and ensures plane surface. The support surface 65 can naturally be equipped with rollers to reduce friction. The lower end of the conveyor belt 63 is immersed under the water surface of the basin 4 and the micro-terraces 10 get filled under the level of water in the basin 4 and moving together with the conveyor belt while carrying the water upwards. At the top of the course the micro-terraces 10 are emptied, the discharged water is collected and conducted back through a water drain 64 directly into the basin 4 or onto the lower levels of the course. The users can access the course by stairs or ladder 59 and start from a launching pad 9 located at the top of the course. The water dislodged by the skier is constantly replaced as a result of the upward motion. The angle of the conveyor belt 63 can be adjusted with the aid of a hydraulic cylinder/piston unit 61 and thereby the slope can be adjusted to be steeper or milder very quickly. The conveyor belt 63 has a stable supporting structure and can be placed on a foundation 60.

If the adjustment is good the person sliding down on the sliding surface 1 will practically remain in the same level or place. The position of the person can be monitored with the help of suitable sensors, and if the person gets too close to the basin the operating speed of the driving motor 62 can be increased. If the person gets too high up, the speed of the driving motor 62 can be reduced. The same result can be achieved with the operation of cylinder/piston unit 61, that is by change the steepness of the sliding surface 1. This solution allows for a compact implementation in a relatively small area and also for training. With a proper design ski beginners can be trained.

Figure 20:
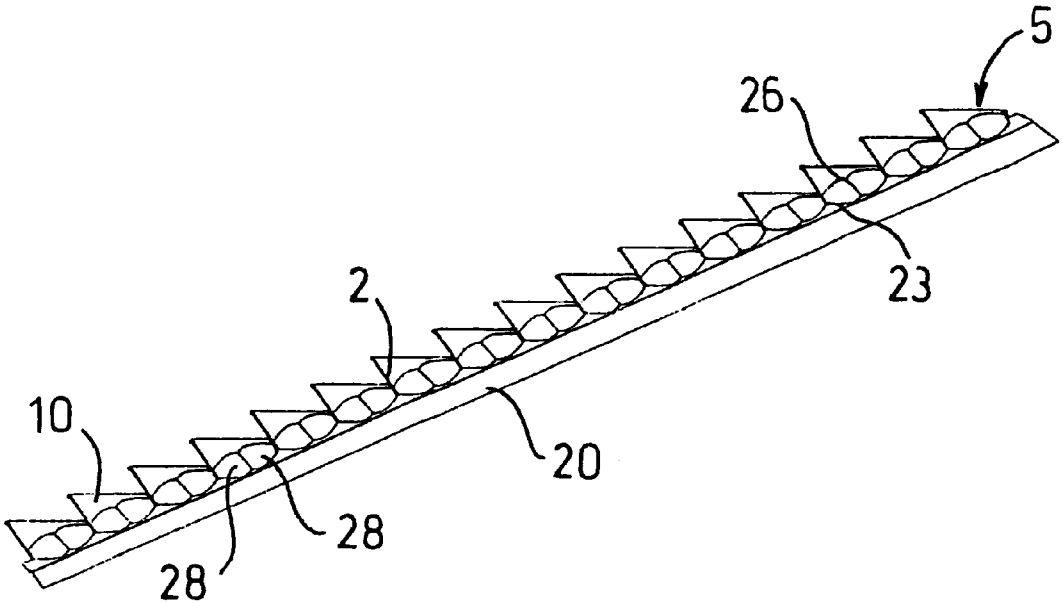
FIG. 20 is the schematic side sectional view of a version of the sliding course according to the invention constructed with covering sheet having inflatable cavities.

FIG. 20 shows a version where the covering sheet 5 placed on the supporting surface 201 has cavities 28. There are two cavities 28 made between two adjacent ribs 2, and two adjacent cavities 28 are separated by spacer rib 26. The spacer rib can be airtight or air permeable. With this structure it is possible to make inflatable sliding surface 23, the flexibility of which reduces significantly the risk of bruises. There is an other inherent possibility, namely that with the use of airtight spacer rib 26 the pressure in the cavities 28 located between two adjacent ribs 2 can be adjusted to different values and thus the angle of the ribs 2 can be adjusted between certain limits, allowing thereby adjustment of the characteristics of the sliding surface 23. A pillow is made from plastic foil with one or more air chambers or pockets an is placed to extend across the slope. The air pockets are made by the cavities 28 between which the ribs 2 are placed, which will occupy their working position after the air pockets are inflated forming then the micro-terraces 10. The bottom of the pillow can be affixed to the support surface 20 by pasting. This version is sensitive to damages but provides a soft surface.

The invention has been described above and shown in the attached drawings on hand on preferred embodiments of the solution according to the invention. However, based on these teachings and presentation person skilled in the art can develop numerous modifications and versions for the invention.

What is claimed is:

1. A sliding course for sliding persons and objects down a slope having a surface, which course includes sliding elements covering the surface of the slope, and a water source for moistening said elements characterized in that said sliding elements comprise pools located one below the other, wherein said pools are forming water filled micro-terraces (10)

characterized in that the pools forming the micro-terraces (10) are formed by a sheet covering the slope in a water-tight manner and flexible ribs (2) are emerging from said sheet, furthermore each pool is bordered by said covering sheet (5) and by at least one of said flexible ribs (2) and is closed by a flexible transverse sectioning rib joined to said covering sheet (5) and said at least one flexible rib (2).

2. The sliding course as claimed in claim 1, characterized in that the surface of the rib (2) accosting the pool is made of a material with low friction coefficient in the moist state.

3. The sliding course as claimed in claim 1, characterized in that the ribs (2) and/or covering sheet is affixed onto an underlay sheet.

4. The sliding course as claimed in claim 3, characterized in that the underlay sheet (6) is made of a self-supporting, rigid material.

5. The sliding course as claimed in claim 1 characterized in that the pools are limited by crossing ribs (2) protruding from the covering sheet (5).

6. The sliding course as claimed in claim 1 characterized in that there is at least one water passage bore in the bottom of each pool.

7. The sliding course as claimed in claim 1 characterized in that there is at least one overflow (6) on each pool.

8. The sliding course as claimed in claim 1 characterized in that there are cavities (28) parallel to the ribs (2) located in the ribs **(2*g*)** and/or covering sheet, closed in an airtight manner and connected to a source of compressed air.

9. The sliding course as claimed in claim 1 in combination with a sliding device suitable for sliding down in at least in one direction characterized by the sliding device comprising a sheet, the front end of which in the one direction is at least partly rounded.

10. The combination as claimed in claim 9 characterized in that the sliding device is shaped in the form of an elongated board having bridles (34) to accommodate the feet on the forward part or grip (45) for hand gripping.

11. The combination as claimed in claim 10 characterized in that at least the end part in the direction of motion of said board is formed to have an upward curve.

12. The combination as claimed in claim 11 characterized in that there are at least two rudders (46, 52) forming a braking oar in respect of the direction of motion.

13. The combination as claimed in claim 10 characterized in that there is a flexible edge part.

14. The combination as claimed in claim 13 characterized in that there is at least one rudder (46, 52) mounted to the board and adapted to be pressed against the sliding surface (1) for steering and braking and that there are longitudinal ribs on the bottom of the sliding device in the direction of motion.

15. A sliding course for sliding persons and objects down a slope having a surface, which course includes sliding elements covering the surface of the slope, and a water source for moistening said elements characterized in that said sliding elements comprise pools located one below the other, wherein said pools are forming water filled micro-terraces (10)

characterized in that it is mounted on a conveyor belt and the water source is a basin (4) located at the bottom of the conveyor belt.

16. The sliding course as claimed in claim 15 characterized in that the inclination angle of the conveyor belt (63) is adjustable.

17. A sliding course for sliding persons and objects down a slope having a surface, which course includes sliding elements covering the surface of the slope, and a water source for moistening said elements characterized in that said sliding elements comprise pools located one below the other, wherein said pools are forming water filled micro-terraces (10), which course includes covering elements covering the surface of the slope, characterized in that said covering element comprises a covering sheet (30) adapted to be fastened to a sloped surface and having a basin (31) on its upper side formed by ribs **(2*z*) located at the lower part of the slope and closed by transverse rib sections (58) at both ends, and having at least one water passage bore (31) at the bottom of the pool and at least one overflow (43), furthermore that the length of the covering sheet (30) along the direction of slope is at least twice and at most thrice the length of the basin (31)** measured in the direction of the slope.

18. A sliding course for sliding persons and objects down a sloped surface, comprising:

sliding elements covering the sloped surface; and a water source for moistening said sliding elements, said sliding elements comprising pools located one below the other, said pools being water filled micro-terraces, said pools being formed by a sheet covering the sloped surface in a water-tight manner and flexible ribs (2) emerging from said sheet, each said pool being bordered by said covering sheet and by at least one of said flexible ribs, and being closed by a flexible transverse sectioning rib joined to said covering sheet and said at least one flexible rib.

19. A sliding course for sliding persons and objects down a sloped surface, comprising:

sliding elements covering the sloped surface; and a water source for moistening said sliding elements, said sliding elements comprising pools located one below the other, said pools being water filled micro-terraces, and covering elements covering the sloped surface, each said covering element comprising a covering sheet adapted to be fastened to a portion of the sloped surface and having a basin on an upper side formed by ribs located at a lower part of the sloped surface portion and closed by transverse rib sections.

* * * * *